US011577367B2

(12) United States Patent
Eckel et al.

(10) Patent No.: US 11,577,367 B2
(45) Date of Patent: Feb. 14, 2023

(54) ELECTROSTATIC PARTICLE ALIGNMENT METHOD AND ABRASIVE ARTICLE

(71) Applicant: 3M INNOVATIVE PROPERTIES COMPANY, St. Paul, MN (US)

(72) Inventors: Joseph B. Eckel, Vadnais Heights, MN (US); Ronald D. Jesme, Plymouth, MN (US); Aaron K. Nienaber, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 17/597,588

(22) PCT Filed: Jun. 30, 2020

(86) PCT No.: PCT/IB2020/056186
§ 371 (c)(1),
(2) Date: Jan. 12, 2022

(87) PCT Pub. No.: WO2021/009600
PCT Pub. Date: Jan. 21, 2021

(65) Prior Publication Data

US 2022/0241931 A1 Aug. 4, 2022

Related U.S. Application Data

(60) Provisional application No. 62/875,700, filed on Jul. 18, 2019.

(51) Int. Cl.
*B24D 18/00* (2006.01)
*B24D 3/00* (2006.01)

(52) U.S. Cl.
CPC ..... *B24D 18/00* (2013.01); *B24D 3/005* (2013.01)

(58) Field of Classification Search
None
See application file for complete search history.

(56) References Cited

U.S. PATENT DOCUMENTS 1,930,788 A 10/1933 Buckner
2,248,853 A * 7/1941 Carlton ..... B24D 11/005 51/298

(Continued)

FOREIGN PATENT DOCUMENTS

GB 396231 8/1933
WO WO 2012-112305 8/2012

(Continued)

OTHER PUBLICATIONS

International Search report for PCT International Application No. PCT/IB2020/056186 dated Aug. 14, 2020, 5 pages.

*Primary Examiner* — Pegah Parvini
*Assistant Examiner* — Ross J Christie
(74) *Attorney, Agent, or Firm* — Katherine M. Scholz

(57) ABSTRACT

A method of aligning abrasive particles on a substrate. The method comprises providing a substrate. The method also comprises providing abrasive particles. The method also comprises generating a modulated electrostatic field. The modulated electrostatic field is configured to have a first effective direction at a first time and a second effective direction at a second time. The electrostatic field is configured to cause the abrasive particles to align rotationally in both a z-direction and a y-direction.

13 Claims, 15 Drawing Sheets

(56) References Cited

U.S. PATENT DOCUMENTS

| | | | | | |
|---|---|---|---|---|---|
| 2,287,837 | A | * | 6/1942 | Smyser | B24D 11/005 427/482 |
| 2,318,570 | A | | 5/1943 | Carlton | |
| 2,370,636 | A | | 3/1945 | Carlton | |
| 2,784,695 | A | * | 3/1957 | Archer | B24D 11/005 118/640 |
| 2,958,593 | A | | 11/1960 | Hoover | |
| 4,018,575 | A | | 4/1977 | Davis | |
| 4,227,350 | A | | 10/1980 | Fitzer | |
| 4,314,827 | A | | 2/1982 | Leitheiser | |
| 4,331,453 | A | | 5/1982 | Dau | |
| 4,609,380 | A | | 9/1986 | Barnett | |
| 4,623,364 | A | | 11/1986 | Cottringer | |
| 4,652,275 | A | | 3/1987 | Bloecher | |
| 4,734,104 | A | | 3/1988 | Broberg | |
| 4,744,802 | A | | 5/1988 | Schwabel | |
| 4,751,137 | A | | 6/1988 | Halg | |
| 4,770,671 | A | | 9/1988 | Monroe | |
| 4,881,951 | A | | 11/1989 | Wood | |
| 4,991,362 | A | | 2/1991 | Heyer | |
| 5,137,542 | A | | 8/1992 | Buchanan | |
| 5,152,917 | A | | 10/1992 | Pieper | |
| 5,201,916 | A | | 4/1993 | Berg | |
| 5,213,591 | A | | 5/1993 | Celikkaya | |
| 5,366,523 | A | | 11/1994 | Horst | |
| 5,417,726 | A | | 5/1995 | Stout | |
| 5,435,816 | A | | 7/1995 | Spurgeon | |
| 5,554,068 | A | | 9/1996 | Carr | |
| 5,573,619 | A | | 11/1996 | Benedict | |
| 5,591,239 | A | | 1/1997 | Larson | |
| 5,672,097 | A | | 9/1997 | Hoopman | |
| 5,681,361 | A | | 10/1997 | Sanders, Jr. | |
| 5,712,210 | A | | 1/1998 | Windisch | |
| 5,858,140 | A | | 1/1999 | Berger | |
| 5,928,070 | A | | 7/1999 | Lux | |
| 5,942,015 | A | | 8/1999 | Culler | |
| 5,946,991 | A | | 9/1999 | Hoopman | |
| 5,975,987 | A | | 11/1999 | Hoopman | |
| 5,984,988 | A | | 11/1999 | Berg | |
| 6,017,831 | A | | 1/2000 | Beardsley | |
| 6,129,540 | A | | 10/2000 | Hoopman | |
| 6,207,246 | B1 | | 3/2001 | Moren | |
| 6,261,682 | B1 | | 7/2001 | Law | |
| 6,302,930 | B1 | | 10/2001 | Lux | |
| 6,475,253 | B2 | | 11/2002 | Culler | |
| 8,034,137 | B2 | | 10/2011 | Erickson | |
| 8,142,531 | B2 | | 3/2012 | Adefris | |
| 8,142,532 | B2 | | 3/2012 | Erickson | |
| 8,142,891 | B2 | | 3/2012 | Culler | |
| 8,764,865 | B2 | | 7/2014 | Boden | |
| 8,869,740 | B2 | | 10/2014 | Moren | |
| 2008/0289262 | A1 | | 11/2008 | Gao | |
| 2009/0165394 | A1 | | 7/2009 | Culler | |
| 2009/0169816 | A1 | | 7/2009 | Erickson | |
| 2012/0227333 | A1 | | 9/2012 | Adefris | |
| 2013/0040537 | A1 | | 1/2013 | Schwabel | |
| 2013/0125477 | A1 | | 5/2013 | Adefris | |
| 2013/0344786 | A1 | | 12/2013 | Keipert | |
| 2015/0224629 | A1 | | 8/2015 | Moren | |

FOREIGN PATENT DOCUMENTS

| | | |
|---|---|---|
| WO | WO 2012-112322 | 8/2012 |
| WO | WO 2016-028683 | 2/2016 |
| WO | WO 2018-149483 | 8/2018 |

* cited by examiner

| | 210A | 210B | 210C | 210D | 210E | 210F | 210G | 210H | 210I | 210J |
|---|---|---|---|---|---|---|---|---|---|---|
| Electrode: | A | B | C | D | E | F | G | H | I | J |
| T1 | - | | | | | - | | | | + |
| T2 | | - | | | | - | | | | + |
| T3 | | | - | | | - | | | | + |
| T4 | | | | - | | - | | | | + |
| T5 | | | | - | | | | | + | |
| T6 | | | - | | | | | + | | |
| T7 | | | | - | | | | + | | |
| T8 | | | | - | | | + | | | |
| T9 | + | | | | - | | + | | | |
| T10 | + | | | | - | + | | | | - |
| T11 | | + | | | | + | | | | - |
| T12 | | | + | | | + | | | | - |
| T13 | | | | + | | + | | | | - |
| T14 | | | | + | | | | | - | |
| T15 | | | + | | | | | - | | |
| T16 | | | | + | | | | - | | |
| T17 | | | | + | | | - | | | |
| T18 | - | | | | + | | - | | | |
| T19 | - | | | | + | - | | | | + |

| Electrode: | A | B | C | D | E | F | G | H | I | J | K | L | M | N | O | P | Q | R |
|---|---|---|---|---|---|---|---|---|---|---|---|---|---|---|---|---|---|---|
| T1 | - | | - | | | | + | | | | | - | | | | + | | |
| T2 | | | | - | | | | + | | | | - | | | | + | | |
| T3 | + | | | | - | | | | + | | | - | | | | + | | |
| T4 | | + | | | | - | | | | | | - | | | | + | | |
| T5 | | | + | | | | - | | | | | - | | | | + | | |
| T6 | | | | + | | | | - | | | | - | | | | + | | |
| T7 | - | | | | + | | | | - | | | - | | | | + | | |
| T8 | | - | | | | + | | | | | | - | | | | + | | |
| T9 | | | - | | | | + | | | | | - | | | | + | | |
| T10 | | | | - | | | | + | | | | - | | | | + | | |
| T11 | + | | | | - | | | | + | | | - | | | | + | | |
| T12 | | + | | | | - | | | | | | - | | | | + | | |
| T13 | | | + | | | | - | | | | | - | | | | + | | |
| T14 | | | | + | | | | - | | | | - | | | | + | | |
| T15 | - | | | | + | | | | - | | | - | | | | + | | |
| T16 | | - | | | | + | | | | | | - | | | | + | | |
| T17 | | | - | | | | + | | | | | - | | | | + | | |

FIG. 3B

| Electrode: | A | B | C | D | E | F | G | H | I | J | K | L | M | N | O | P | Q | R |
|---|---|---|---|---|---|---|---|---|---|---|---|---|---|---|---|---|---|---|
| T1 | - | | - | | | | + | | | | | - | | | | + | | |
| T2 | | | | - | | | | + | | | | - | | | | + | | |
| T3 | + | | | | - | | | | + | | | - | | | | + | | |
| T4 | | + | | | | - | | | | | | - | | | | + | | |
| T5 | | | + | | | | - | | | | | - | | | | + | | |
| T6 | | | | + | | | | - | | | | - | | | | + | | |
| T7 | - | | | | + | | | | - | | | - | | | | + | | |
| T8 | | - | | | | + | | | | | | - | | | | + | | |
| T9 | | | - | | | | + | | | | | - | | | | + | | |
| T10 | | | | - | | | | + | | | | - | | | | + | | |
| T11 | + | | | | - | | | | + | | | - | | | | + | | |
| T12 | | + | | | | - | | | | | | - | | | | + | | |
| T13 | | | + | | | | - | | | | | - | | | | + | | |
| T14 | | | | + | | | | - | | | | - | | | | + | | |
| T15 | - | | | | + | | | | - | | | - | | | | + | | |
| T16 | | - | | | | + | | | | | | - | | | | + | | |
| T17 | | | - | | | | + | | | | | - | | | | + | | |

*FIG. 8B*

ELECTROSTATIC PARTICLE ALIGNMENT METHOD AND ABRASIVE ARTICLE

CROSS REFERENCE TO RELATED APPLICATIONS

This application is a national stage filing under 35 U.S.C. 371 of PCT/IB2020/056186, filed Jun. 30, 2020, which claims the benefit of U.S. Provisional Application No. 62/875,700, filed Jul. 18, 2019, the disclosure of which is incorporated by reference in its/their entirety herein.

BACKGROUND

Various types of abrasive articles are known in the art. For example, coated abrasive articles generally have abrasive particles adhered to a backing by a resinous binder material. Examples include sandpaper and structured abrasives having precisely shaped abrasive composites adhered to a backing. The abrasive composites generally include abrasive particles and a resinous binder.

Bonded abrasive particles include abrasive particles retained in a binder matrix that can be resinous or vitreous. Examples include, grindstones, cutoff wheels, hones, and whetstones.

Alignment and orientation of abrasive particles in abrasive articles such as, for example, coated abrasive articles and bonded abrasive articles has been a source of continuous interest for many years.

For example, coated abrasive articles have been made using techniques such as electrostatic coating of abrasive particles have been used to align crushed abrasive particles with the longitudinal axes perpendicular to the backing. Likewise, shaped abrasive particles have been aligned by mechanical methods as disclosed in U. S. Pat. Appl. Publ. No. 2013/0344786 A1 (Keipert).

Precise placement and orientation of abrasive particles in bonded abrasive articles has been described in the patent literature. For example, U.S. Pat. No. 1,930,788 (Buckner) describes the use of magnetic flux to orient abrasive grain having a thin coating of iron dust in bonded abrasive articles. Likewise, British (GB) Pat. No. 396,231 (Buckner) describes the use of a magnetic field to orient abrasive grain having a thin coating of iron or steel dust to orient the abrasive grain in bonded abrasive articles. Using this technique, abrasive particles were radially oriented in bonded wheels.

U.S. Pat. Appl. Publ. No. 2008/0289262 A1 (Gao) discloses equipment for making abrasive particles in even distribution, array pattern, and preferred orientation. Using electric current to form a magnetic field causing acicular soft magnetic metallic sticks to absorb or release abrasive particles plated with soft magnetic materials.

The use of an electrostatic field to apply abrasive grains to a coated backing of an abrasive article is well known. For example, U.S. Pat. No. 2,370,636 issued to Minnesota Mining and Manufacturing Company in 1945 discloses the use of an electrostatic field for affecting the orientation of abrasive grains such that each abrasive grain's elongated dimension is substantially erect (standing up) with respect to the backing's surface.

SUMMARY

A method of aligning abrasive particles on a substrate. The method comprises providing a substrate. The method also comprises providing abrasive particles. The method also comprises generating a modulated electrostatic field. The modulated electrostatic field is configured to have a first effective direction at a first time and a second effective direction at a second time. The electrostatic field is configured to cause the abrasive particles to align rotationally in both a z-direction and a y-direct.

BRIEF DESCRIPTION OF THE DRAWINGS

It is to be understood by one of ordinary skill in the art that the present discussion is a description of exemplary embodiments only and is not intended as limiting the broader aspects of the present disclosure, which broader aspects are embodied in the exemplary construction.

FIGS. 3A-C illustrate another example system for providing a modulated electrostatic field and the effective produced electrostatic field in an embodiment of the invention.

FIGS. 8A-8D illustrate an example electrostatic system in accordance with embodiments of the present invention.

DEFINITIONS

Figure 1A:
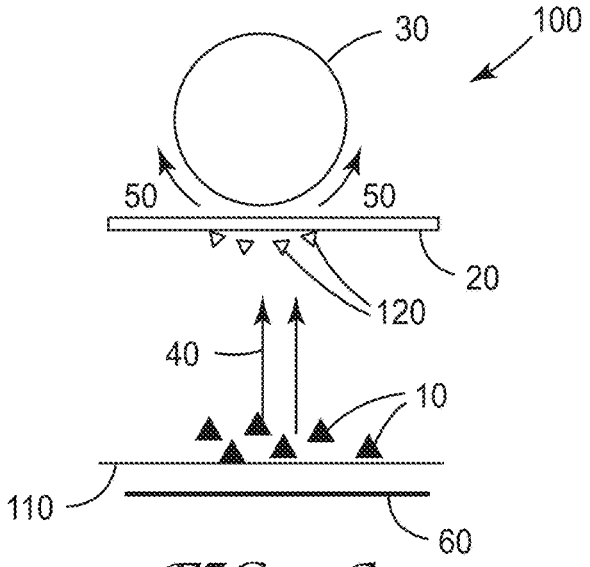
FIG. 1A illustrates an electrostatic system for applying particles to a substrate in an embodiment of the invention.

As used herein, forms of the words "comprise", "have", and "include" are legally equivalent and open-ended. Therefore, additional non-recited elements, functions, steps or limitations may be present in addition to the recited elements, functions, steps, or limitations.

As used in this Specification, the recitation of numerical ranges by endpoints includes all numbers subsumed within that range (e.g., 1 to 5 includes 1, 1.5, 2, 2.75, 3, 3.8, 4, and 5, and the like).

Unless otherwise indicated, all numbers expressing quantities or ingredients, measurement of properties and so forth used in the Specification and embodiments are to be understood as being modified in all instances by the term "about." Accordingly, unless indicated to the contrary, the numerical parameters set forth in the foregoing specification and attached listing of embodiments can vary depending upon the desired properties sought to be obtained by those skilled in the art utilizing the teachings of the present disclosure. At the very least, and not as an attempt to limit the application of the doctrine of equivalents to the scope of the claimed embodiments, each numerical parameter should at least be construed in light of the number of reported significant digits and by applying ordinary rounding techniques.

The terms "about" or "approximately" with reference to a numerical value or a shape means +/−five percent of the numerical value or property or characteristic, but also expressly includes any narrow range within the +/−five percent of the numerical value or property or characteristic as well as the exact numerical value. For example, a temperature of "about" 100° C. refers to a temperature from 95° C. to 105° C., but also expressly includes any narrower range of temperature or even a single temperature within that range, including, for example, a temperature of exactly 100° C. For example, a viscosity of "about" 1 Pa-sec refers to a viscosity from 0.95 to 1.05 Pa-sec, but also expressly includes a viscosity of exactly 1 Pa-sec. Similarly, a perimeter that is "substantially square" is intended to describe a geometric shape having four lateral edges in which each lateral edge has a length which is from 95% to 105% of the length of another lateral edge, but which also includes a geometric shape in which each lateral edge has exactly the same length.

The term "substantially" with reference to a property or characteristic means that the property or characteristic is exhibited to a greater extent than the opposite of that property or characteristic is exhibited. For example, a substrate that is "substantially" transparent refers to a substrate that transmits more radiation (e.g. visible light) than it fails to transmit (e.g. absorbs and reflects). Thus, a substrate that transmits more than 50% of the visible light incident upon its surface is substantially transparent, but a substrate that transmits 50% or less of the visible light incident upon its surface is not substantially transparent.

The term "length" refers to the longest outer surface-to-outer surface dimension of an object.

The term "width" refers to the longest dimension of an object that is perpendicular to its length.

The term "thickness" refers to the longest dimension of an object that is perpendicular to both of its length and width.

The term "aspect ratio" is defined as largest dimension divided by the largest dimension present along an axis defined by the largest dimension."

The term "modulated electrostatic field" refers to an electrostatic field that changes in direction and optionally magnitude. The change can be continuous or discrete, e.g. an electrode changing from a positive to negative charge.

The suffix "(s)" indicates that the modified word can be singular or plural.

The term "monodisperse" describes a size distribution in which all the particles are approximately the same size.

The terms "a", "an", and "the" include plural referents unless the content clearly dictates otherwise. Thus, for example, reference to a material containing "a compound" includes a mixture of two or more compounds.

The term "ceramic" refers to any of various hard, brittle, heat- and corrosion-resistant materials made of at least one metallic element (which may include silicon) combined with oxygen, carbon, nitrogen, or sulfur. Ceramics may be crystalline or polycrystalline, for example.

The ceramic particles may be shaped (e.g., precisely-shaped) or random (e.g., crushed and/or platey). Shaped ceramic particles and precisely-shaped ceramic particles may be prepared by a molding process using sol-gel technology as described, for example, in U.S. Pat. No. 5,201,916 (Berg), U.S. Pat. No. 5,366,523 (Rowenhorst (Re 35,570)), U.S. Pat. No. 5,984,988 (Berg), U.S. Pat. No. 8,142,531 (Adefris et al.), and U.S. Pat. No. 8,764,865 (Boden et al.). Exemplary shapes of ceramic particles include crushed, pyramids (e.g., 3-, 4-, 5-, or 6-sided pyramids), truncated pyramids (e.g., 3-, 4-, 5-, or 6-sided truncated pyramids), cones, truncated cones, rods (e.g., cylindrical, vermiform), and prisms (e.g., 3-, 4-, 5-, or 6-sided prisms). In some embodiments (e.g., truncated pyramids and prisms), the ceramic particles respectively comprise platelets having two opposed major facets connected to each other by a plurality of side facets.

The term "essentially free of" means containing less than 5 percent by weight (e.g., less than 4, 3, 2, 1, 0.1, or even less than 0.01 percent by weight, or even completely free) of, based on the total weight of the object being referred to.

The terms "precisely-shaped abrasive particle" refers to an abrasive particle wherein at least a portion of the abrasive particle has a predetermined shape that is replicated from a mold cavity used to form a precursor precisely-shaped abrasive particle that is sintered to form the precisely-shaped abrasive particle. A precisely-shaped abrasive particle will generally have a predetermined geometric shape that substantially replicates the mold cavity that was used to form the abrasive particle.

As used herein, "substantially horizontal" means within ±10, ±5, or ±2 degrees of perfectly horizontal. As used herein, "substantially vertical" means within ±10, ±5, or ±2 degrees of perfectly vertical. As used herein, "substantially orthogonal" means within ±20, ±10, ±5, or ±2 degrees of 90 degrees.

As used herein, "z-direction rotational orientation" refers to the particle's angular rotation about its longitudinal axis. As used herein, "y-direction rotation orientation" refers to the particle's angular rotation about its latitudinal axis. The latitudinal axis of the particle is aligned with the electrostatic field as the particle is translated through the air by the electrostatic force.

DETAILED DESCRIPTION

In conventional electrostatic systems, abrasive particles can be applied to coated backings by conveying the abrasive particles horizontally under the coated backing traveling parallel to and above the abrasive particles on the conveyer belt. The conveyor belt and coated backing pass through a region that is electrostatically charged by a bottom plate connected to a voltage potential and a grounded upper plate. The abrasive particles then travel substantially vertically under the force of the electrostatic field, and against gravity, attaching to the coated backing and achieving an erect orientation with respect to the coated backing. A significant number of the abrasive particles align their longitudinal axis parallel to the electrostatic field prior to attaching to the coated backing.

Additionally, electrostatic deposition of abrasive particles onto a curable layer (e.g., a make coat) is well-known in the abrasive art (e.g., see U.S. Pat. No. 2,318,570 (Carlton) and U.S. Pat. No. 8,869,740 (Moren et al.)), and analogous technique wherein the slurry layer is substituted for the curable layer is effective for accomplishing electrostatic deposition of abrasive particles. And it has been possible to orient particles by controlling the z-directional rotation (U.S. 2015/0224629 (Moren et al.)). However, it is desired to be able to also control y-directional rotational direction of the abrasive particles. For example, it is known that abrasive particles can have better cutting efficiency when rotationally oriented properly. For example, if tips or edges of particles can be rotationally oriented with respect to a direction of use of an abrasive article, the plurality of tips or edges can have greater abrading efficiency. Previous efforts have focused on a static, parallel plate system to create a charge on abrasive particles, causing them to orient in the z-direction. Embodiments described herein utilize a dynamic electrostatic system that modulates the direction of charge experienced by abrasive particles, causing them to generally orient with respect to the backing but also rotationally orient with respect to a proposed direction of use.

The embodiments described herein are described with respect to abrasive particles, particularly with respect to abrasive particles being applied to a backing. However, it is expressly contemplated that the embodiments described herein are also applicable to other applications. For example, any application that positions particulates on a substrate, where rotational orientation and/or alignment of the particulates can affect the performance of the resulting product.

Alignment of abrasive particles on a backing is possible by applying a magnetic coating and using a magnetic field. However, this requires a magnetic coating on the abrasive particles. This coating can require an extra process step and associated cost. Iron, a common metal used in magnetic coating, can present concerns for contamination in certain applications. Therefore, a process is desired that can align abrasive particles on or within an abrasive article without requiring a magnetic coating.

Electrostatic System

Figure 1B:
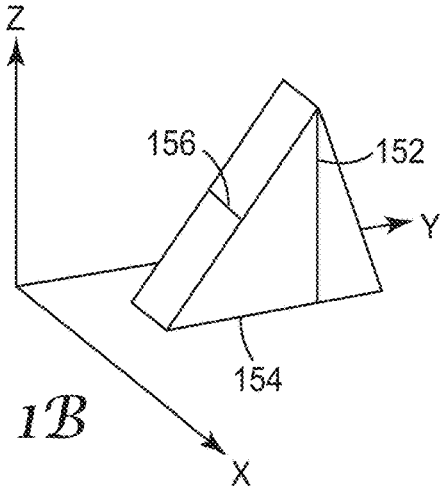
FIG. 1B illustrates an example of a particle in an X-Y-Z coordinate system.

FIG. 1A illustrates an electrostatic system for applying particles to a substrate in an embodiment of the invention. System 100 is illustrated and described with respect to applying abrasive particles 10 onto a backing 20. However, system 100 may also have other applications for other technology areas. FIG. 1B illustrates one example particle which could be aligned on a backing using electrostatic system 100. However, while a triangular particle 150 is illustrated for explanatory purposes, it is expressly contemplated that systems and methods described herein can be used to align a variety of particles including other precision shaped particles, other formed particles, platey or crushed particles.

Particle 150 can be understood as having a length 152, a width 154, and a thickness 156. It also has an aspect ratio, which is defined as the ratio of length 152 to width 154. As illustrated in FIG. 1B, it may be possible to align a particle 150 on a substrate in any of the x, y or z directions. A substrate may be located, for example, in or below the X-Y plane. As discussed in detail in US Patent Application Publication 2013/0344786 to Keipert, rotational orientation of abrasive particles on a backing can have a significant effect on performance of an abrasive article.

Particle 150 may be oriented along any of axes x, y or z using systems and methods described herein. Orientation with respect to the X-axis can be controlled based on how frequently, and where, particles 150 are dispensed with respect to a substrate. As illustrated in US PAP 2013/0344786 to Keipert, which is incorporated by reference herein, rotational orientation with respect to the Z-axis can improve abrasive cutting effectiveness.

Systems and methods herein allow for rotational orientation with respect to the Y-axis, e.g. with respect to an edge of a substrate. It may be possible to achieve better abrading efficiency when width 154 is parallel to, or substantially parallel to, an edge of a substrate to which particles will be fixed.

Referring back to FIG. 1A, a particle source 110 provides abrasive particles 10 to system 100. Abrasive particles 10 may, for example, be precision shaped particles, formed particles, platey or crushed particles. Particle source 110 could be, for example, a conveyor belt, a ramp, or other conveyance mechanism. Additionally, particle source 110 may also providing a screening function, such that particles 10 are all similarly sized.

A substrate 20 is also provided that is not initially in contact with provided particles 10. Substrate 20 may have a binder precursor material on it or may be free of binding material. Substrate 20 may be a non-woven, flexible, or stiff backing material.

A modulating electrostatic field generator 30 is provided. The modulating electrostatic field generator 30 is positioned opposite a plate 60. When actuated, modulating electrostatic field generator 30 creates an electrostatic field that draws particles 10 away from plate 60 and toward backing 20 through field 40. Electrostatic field generator 30 modulates a generated electrostatic field as it rotates back and forth, as indicated by arrows 50. The rotation causes an effective electric field experienced by a particle to change as generator 30 moves between a first and a second position and, optionally, back again. Modulation refers to the changing of experienced electrostatic field on an abrasive particle over time. Modulating may refer to a continuous change, for example caused by rotation of field generator 30, or may refer to a discrete change, for example caused by plate 60 changing magnitude or direction without going through intermediate values.

Generator 30 and plate 60 are differently charged. For example, generator 30 may be positively charged and plate 60 may be a ground. Generator 30 may be positively charged and plate 60 may be negatively charged. Other configurations are also possible and contemplated herein such that, when actuated, particles 10 are moved away from a source 110 and toward a backing 20. The modulating electrostatic field generator can use either a direct current or an alternating current source to create a modulated electrostatic field. Additionally, voltage-based sources may also be used to create a modulated electrostatic field, in some embodiments.

In one embodiment, modulated field generator 30 is configured to rotate either clockwise or counterclockwise, as indicated by arrows 50. In one embodiment, modulated field generator 30 is configured to, as it rotates, change directionality of field 40. Prior art alignment systems that focused on a parallel plate architecture were only able to achieve alignment of particles in the z-direction. However, modulating an experienced electric field using generator 30, it is possible to improve alignment of particles on a substrate in the y-direction as well. In the system illustrated in FIG. 1A, modulation occurs by rotating electrostatic field generator 30 with respect to the particle, which may cause the particle to 'wiggle' as it is translated and positioned on backing 20 until a preferred alignment is obtained.

Aligned particles 120 may be adhered to backing 20 during or after an alignment process. For example, backing 20 may comprise a binder that receives aligned particles 120, in one embodiment. However, in another embodiment, a binder is applied to aligned particles 120 after the alignment process is complete.

Figure 1C:
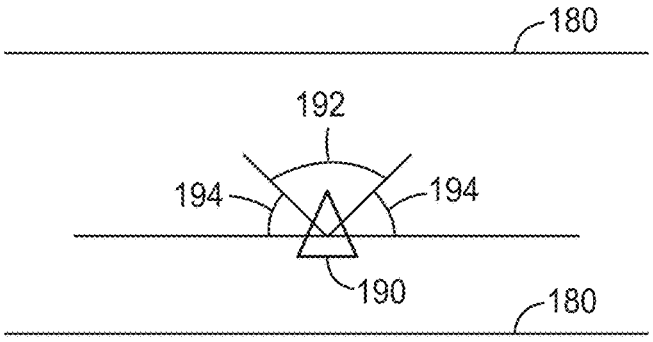
FIG. 1C illustrates a rotational range of the electrostatic system of FIG. 1A.

A preferred alignment may be illustrated in FIG. 1C. In one embodiment, it is desired for an abrasive particle 190 to be aligned substantially parallel to the edges of a backing 180. Preferred orientations of abrasive particles 190 are represented by angle ranges 194. Suboptimal orientations are represented by angle ranges 192. A preferred rotational orientation of abrasive particles 190, in one embodiment, has abrasive particles rotationally aligned with between about 45° and 135° degrees of rotation with respect to edges of a backing 180. Outside of that range, abrasive particles experience fracturing of larger scrap portions, which reduces the life of the particle as it keeps each active sharp tip for less time prior to fracturing and loses more mass with each experienced fracture. However, in other embodiments, other abrasive articles, and for other abrasive particle shapes, other rotational orientations may be desired.

Additionally, while FIG. 1A illustrates a system 100 that relies on a horizontally provided source 110 to provide particles 10 that are sufficiently charged to defy gravity to contact backing 20, it is also expressly contemplated that other embodiments are possible. For example, plate 60 could also be a second modulating field generator configured to rotate in the same, or opposite, direction from field generator 30. Additionally, the position of plate 60 and field generator 30 could be switched, such that particles 10 fall onto backing 20 through field 40. This may allow for a weaker field to be used, as particles 10 would not have to defy gravity during orientation.

While FIG. 1 illustrates a simpler electrostatic field generation system 100, which applies an electrostatic field 40 over the diameter of field generation system 30, it is envisioned that, in other embodiments, abrasive particles may experience an electrostatic field over a longer distance. As a conveyance mechanism moves abrasive particles through an electrostatic field, it may cause them to increasingly change alignment with respect to a substrate, causing a greater percentage of abrasive particles to achieve an alignment within a rotational orientation within a specific angle range.

Figure 2A:
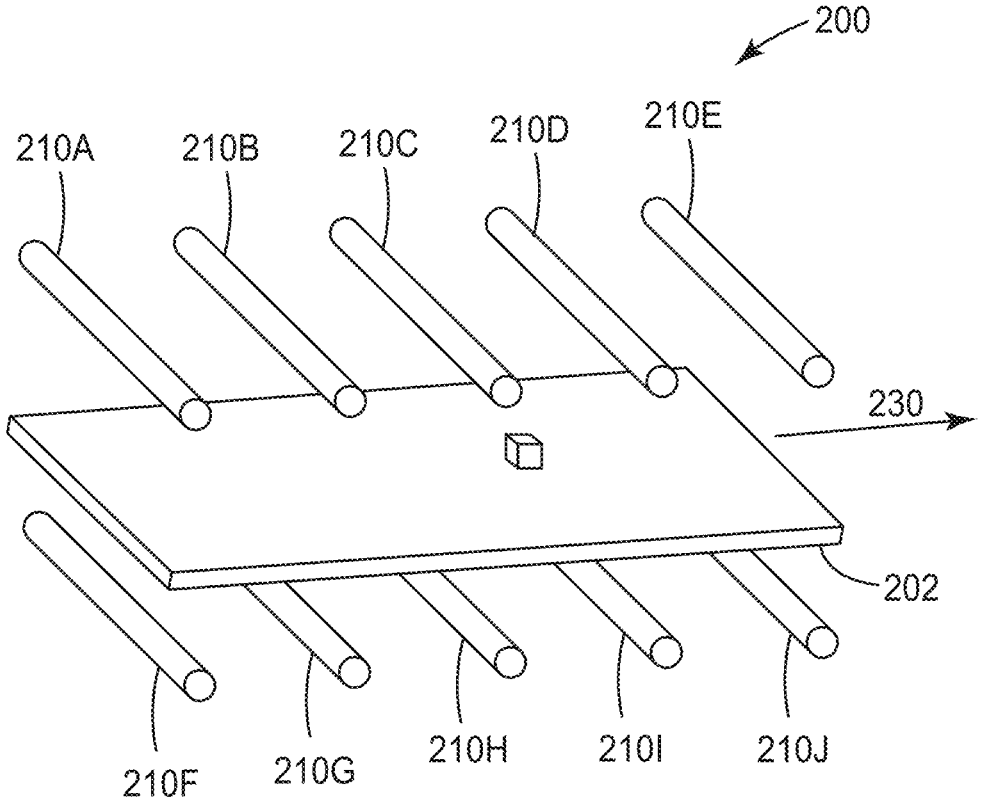
FIGS. 2A-2C illustrate an example system for providing a modulated electrostatic field and the effective produced electrostatic field in an embodiment of the invention.
Figure 2B:
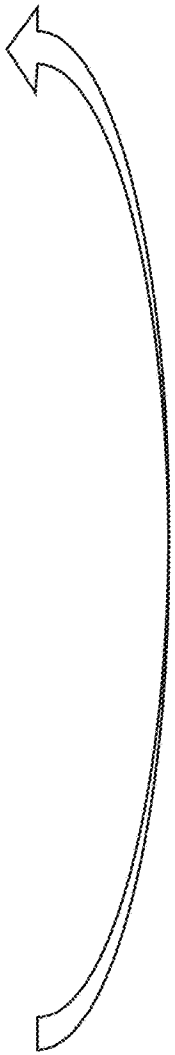
Figure 2C:
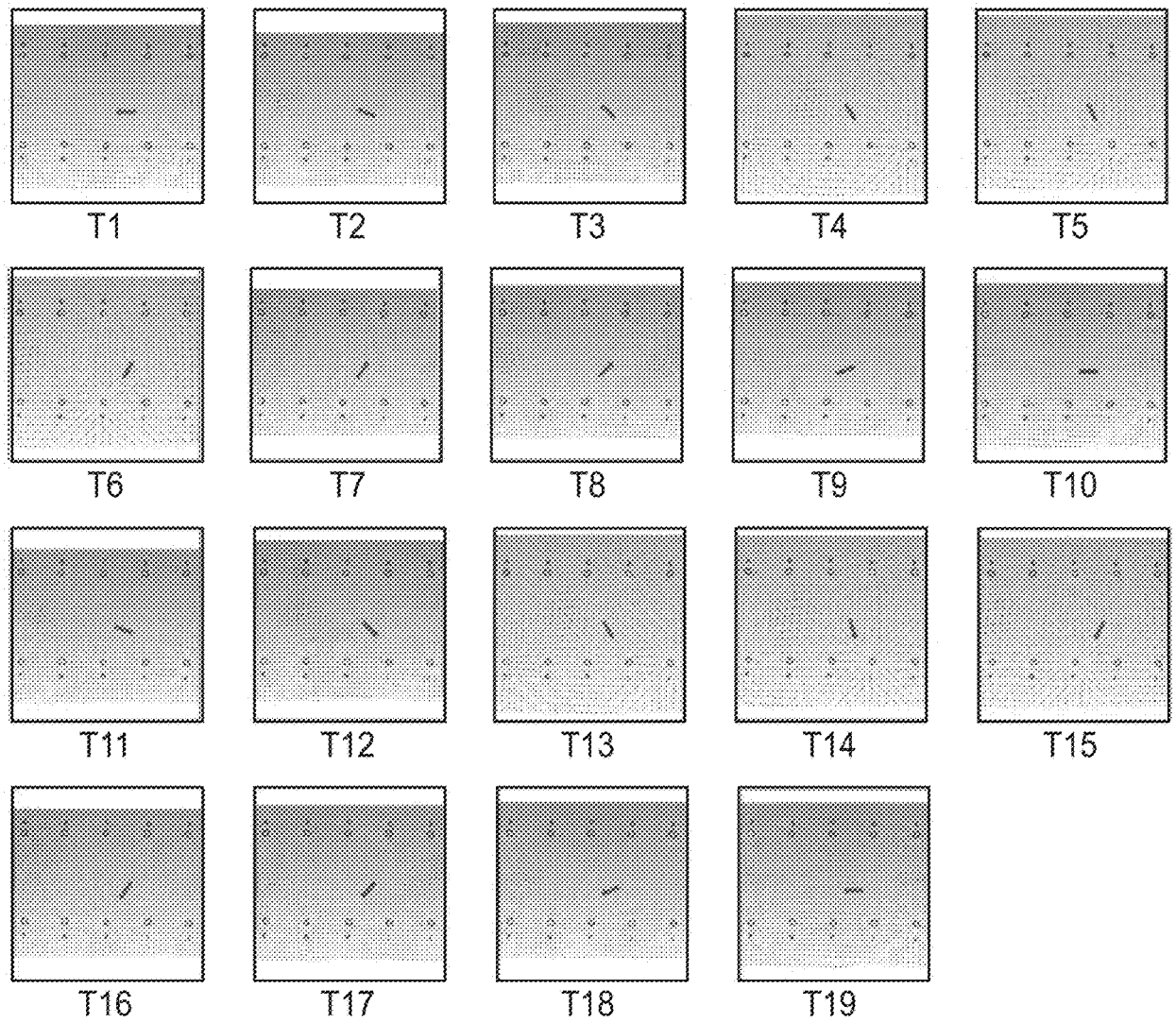

FIGS. 2A-2C illustrate a system for aligning particles on a backing in an embodiment of the invention. A substrate may move in the direction indicated by arrow 230, such that a given particle 240 is exposed to a modulating electrostatic field as substrate moves in direction 230. However, in another embodiment, a substrate remains stationary during an alignment process. In one embodiment, a modulated electrostatic field is provided through an electrode array. Each electrode in the array can be controlled, and charged, by a voltage controller. For example, each electrode can be charged to a significant positive voltage, negative voltage, or substantially no voltage. For example, a voltage of +/−5 kV may be applied, or a voltage of +/−10 kV, or a voltage of +/−15 kV, or a voltage of +/−20 kV, or a voltage of +/−25 kV, or a voltage of +/−30 kV.

A single repeatable electrostatic system element 200 is illustrated in FIG. 2A. However, system 200 may be repeated along a manufacturing line as needed. For example, different sizes and shapes of abrasive particles may require longer dwell times within an electrostatic field to achieve alignment within a preferred rotational orientation range, requiring more, or fewer, passes through electrostatic system element 200 than other shaped/sized particles. Higher line-speeds may require a longer electrostatic system to achieve the desired dwell time of a particle within the electrostatic field.

In the example of FIGS. 2A-2C, the web is simulated as about 0.2" above the lower electrodes. These electrodes were modeled and simulated as an array of 10 copper wires, 0.02" diameter, vertically spaced 0.5", and spaced 0.25" horizontally. The wires are shown with an exaggerated diameter for clarity.

As illustrated in FIG. 2A, system 200 comprises a plurality of first electrodes 210A-E, and a plurality of second electrodes 220F-J. While five sets of electrodes are illustrated, in other embodiments more, or fewer, electrode pairs are present. For example, while FIG. 1A illustrated an embodiment with a single pair of electrodes, two pairs, three pairs, four pairs or more than five pairs may be present within a repeatable system 200.

Additionally, while illustrated as pairs of electrodes, it is expressly contemplated that some embodiments have other electrode configurations. For example, the top electrodes may be more closely spaced than the bottom electrodes. Additionally, an electrode on the top does not need to align, or be associated with, an electrode on the bottom. Further, electrodes on the top (or bottom) may not be equally spaced, from each other. Different physical configurations may require different voltage sequencing.

Each of electrodes 210A-E and 220F-J, in one embodiment, is in a fixed position, with modulation of an experienced electrostatic field occurring as particles 240 on a backing 202, moves through the generated electric field in the direction indicated by arrow 230. The modulated electric field causes the abrasive particles to 'wiggle' or shift position with respect to substrate 202. In addition to causing particles 205 to orient themselves rotationally in the z-direction, e.g. such that a length of a given particle 205 is substantially perpendicular to substrate 202, the modulated electric field causes a particle 205 to orient itself in the y-direction such that a width is substantially parallel to the edges of substrate 202. In another embodiment, different charges are applied to electrodes 210A-E and/or 220F-J while backing 202 remains stationary, causing modulation of the electrostatic field experienced by each of particles 205. However, in some embodiments it is expressly contemplated that, in the z-direction, particles 205 may be rotationally oriented at an angle with respect to the backing.

FIGS. 2B and 2C illustrate the electric field experienced by a particle 205 on substrate 202 at a given time. FIG. 2B illustrates one example sequence of charges on electrodes 210A-E and 220F-J at different time steps. The time step sequence of FIG. 2B shows one complete revolution of the electric field. For time step T1, electrodes 210A and 210F are charged to −5 kV, electrodes 220E and 220J are charged to +5 kV, and all other electrodes are not driven to a specific voltage but are left floating. In FIGS. 2B and 2C, the electrodes undergo 18 different configurations before repeating (e.g. T19 is identical to T1). FIG. 2C illustrates field diagrams of the electric field experienced by a particle at position 240. A wide range of timesteps may be appropriate, depending on the particle size and the strength of the electrostatic field. For example, the timesteps may be as on the order of about 0.01 ms, or 0.1 ms, or 1 ms, or 10 ms or 100 ms.

Figure 3A:
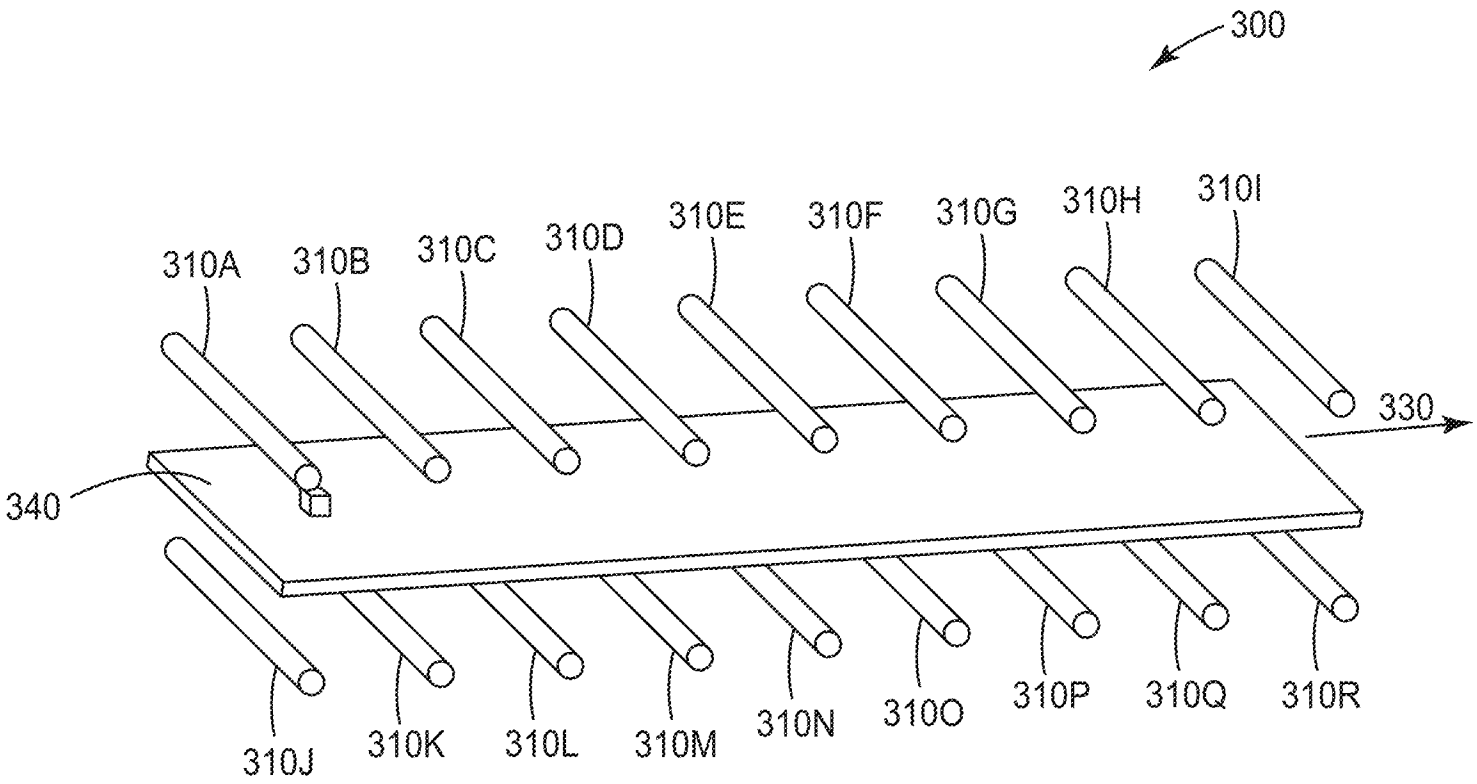
Figure 3C:
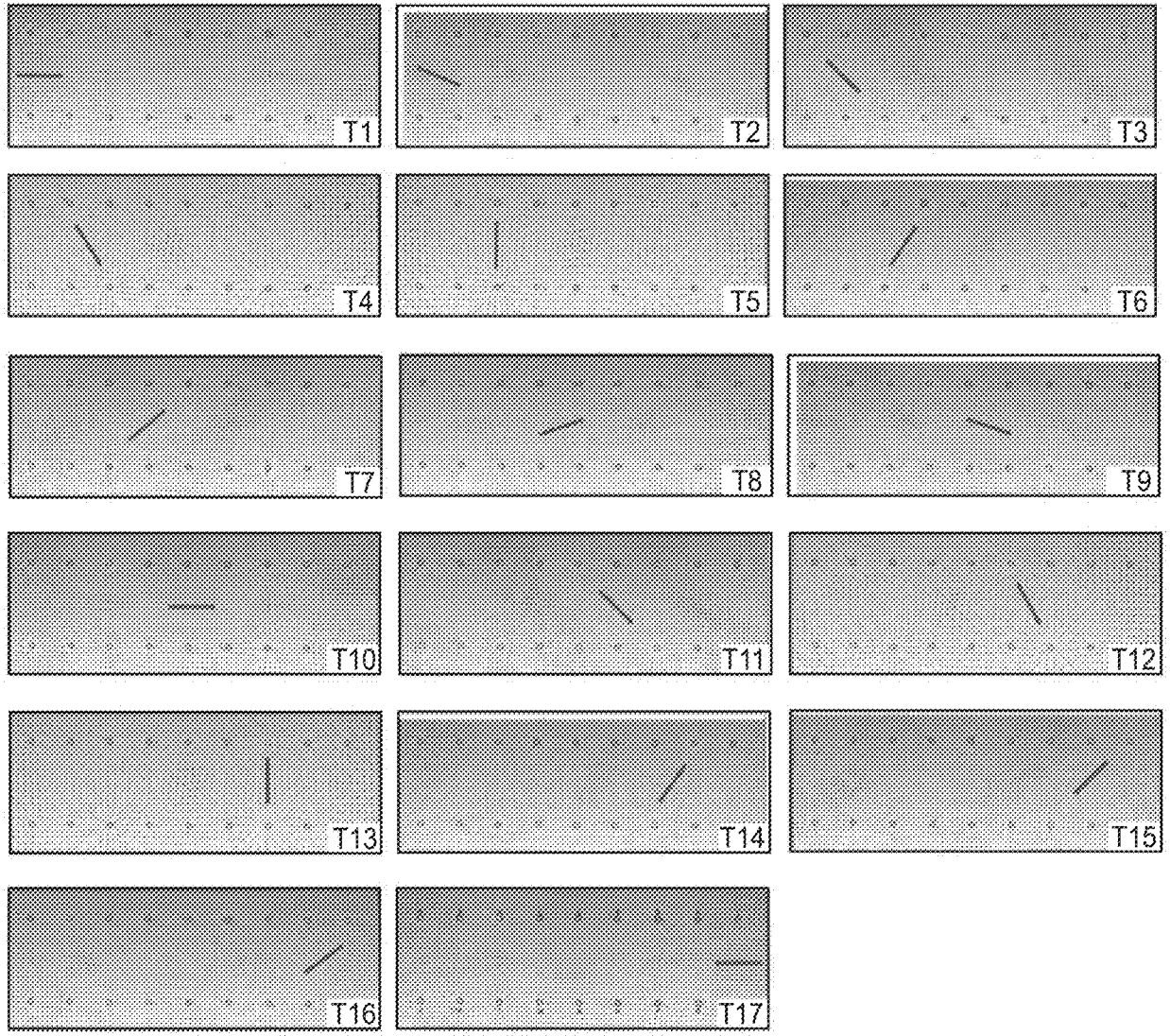

FIGS. 3A-3C illustrate another system for aligning particles on a backing in an embodiment of the invention. System 300 has nine pairs of electrodes, with first electrodes 310A-I opposing electrodes 320J-320R. However, while nine pairs of electrodes are present in FIGS. 3A-3C, systems in other embodiments may have fewer, e.g. six pairs, seven pairs, eight pairs, or additional pairs, e.g. ten, eleven or more. Additionally, while illustrated as pairs of electrodes, it is expressly contemplated that some embodiments have other electrode configurations. For example, the top electrodes may be more closely spaced than the bottom electrodes. Additionally, an electrode on the top does not need to align, or be associated with, an electrode on the bottom. Further, electrodes on the top (or bottom) may not be equally spaced, from each other. Different physical configurations may require different voltage sequencing.

Electrodes 310A-I and 320J-R were modeled and simulated as an array of 18 copper wires, 0.02" diameter, vertically spaced 0.5", and spaced 0.25" horizontally. The wires are shown with an exaggerated diameter for clarity. Particle 340 indicates the point in space where the simulation analysis begins at time T1. The web may or may-not be moving in direction 330; the simulation and analysis is the same either way. However, it may be of use to move the web at the same speed as the rotating field travels, enabling a particle to remain in a rotating field that does not appear to be traveling, when viewed from the perspective of a particle on the moving web.

As illustrated in FIG. 3B, electrodes 310A-I and 320J-R undergo a sequence of charges at sixteen different time steps before repeating (e.g. T17 is identical to T1). However, in other embodiments, more or fewer charge configurations may be present in different time steps before the sequence repeats. For example, one embodiment includes only two charge configurations, such that modulation comprises switching from a first configuration to a second configuration, and back to the first configuration. FIG. 3C illustrates field diagrams of the electric field experienced by a particle at position 340 as it moves through the electrode pairs in the direction 230.

Methods of Using Electrostatic Systems

Several different systems of applying a modulated electrostatic field have been discussed. In some embodiments, methods of use discussed below apply to the systems described above. However, the methods described below may be useful with other system designs.

Figure 4:
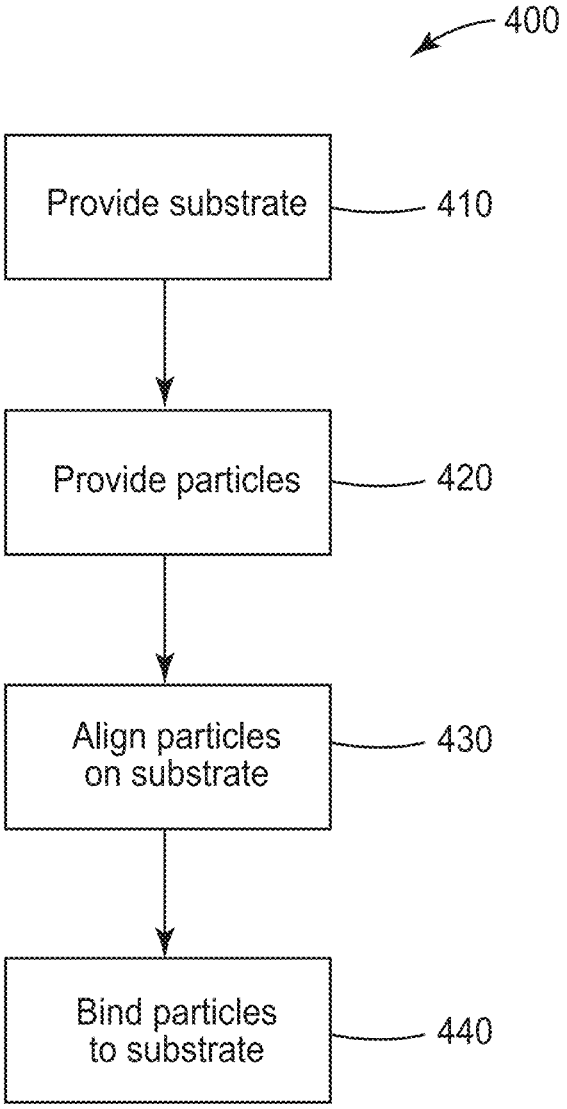
FIG. 4 illustrates a method for aligning particles on a substrate in an embodiment of the present invention.

FIG. 4 illustrates a method for aligning particles on a substrate in an embodiment of the invention. Method 400 may be useful for aligning abrasive particles on a backing, for example.

In step 410, a substrate is provided. In the example of abrasives, the substrate may be a nonwoven or other suitable backing material. An abrasive article substrate may be flexible or stiff, depending on an application need. In some embodiments, the substrate is provided with a binder precursor already applied, such that the abrasive particles embed themselves into the binder precursor layer in response to an experienced electric field. However, in other embodiments there is no binder precursor applied to a substrate prior to particle alignment. Additionally, in some embodiments, a binder precursor may be applied to the particles such that the precursor can be activated once the particles are aligned in a desired orientation. For example, abrasive particles may comprise a hot-melt coating that can be heat-activated once the particles are aligned on a backing. Additionally, coatings that improve static charge or static control could also be used in order to improve alignment.

In step 420, particles are provided. In one embodiment, particles are provided to an electrostatic field on a conveyance mechanism. However, in another embodiment, particles are provided through a size-limiting screen such that only similarly sized particles are received for alignment. However, other suitable methods for providing particles are also envisioned.

In step 430, the particles are aligned on the substrate. Alignment may take place in a batch or a continuous process. For example, the system illustrated in FIG. 1 could receive a batch of particles at a given time for alignment on a substrate, or it could receive a continuous stream of particles and a continuous supply of backing material. The systems in FIGS. 2A and 3A can be configured to receive particles continuously, for example from a conveyor belt, at a regular rate through a screen, etc. Alignment takes place, in one embodiment, by modulating the experienced electrostatic field on a particle. For example, a single electrostatic field generator may rotate, causing a directionality of a generated electric field to shift as it rotates. In another embodiment, multiple electrodes may be present and may rotate or otherwise change an experienced electrostatic field. The changing experienced electrostatic field may cause a particle to wobble, or shift, into a preferred alignment position with respect to the substrate. In one embodiment, alignment comprises more particles aligned within a preferred orientation range than would occur randomly. In one embodiment, the acceptable orientation range is with respect to an edge of the backing such that oriented particles are substantially parallel to an edge of the backing.

In step 440, the particles are bound to the substrate. In an example of a coated abrasive article, this may be accomplished by adding a make coat to the substrate in step 410 and allowing the make coat to cure in step 440. In a nonwoven abrasive article example a resin-based or other binder may be applied to the substrate and aligned abrasive particles in step 440 to hold the abrasive particles in place. Additionally, in some embodiments, a binder precursor may be applied and later activated once particles are aligned. These and/or other suitable binders and methods of fixing particles to a backing are also envisioned. While steps 430 and 440 are described separately, in some embodiment they occur substantially concurrently. For example, the binder resin could include a pressure sensitive adhesive that binds the particles to the substrate during alignment. Alternatively, the binder could comprise a resin that cures in the atmospheric conditions under which alignment takes place.

Figure 5A:
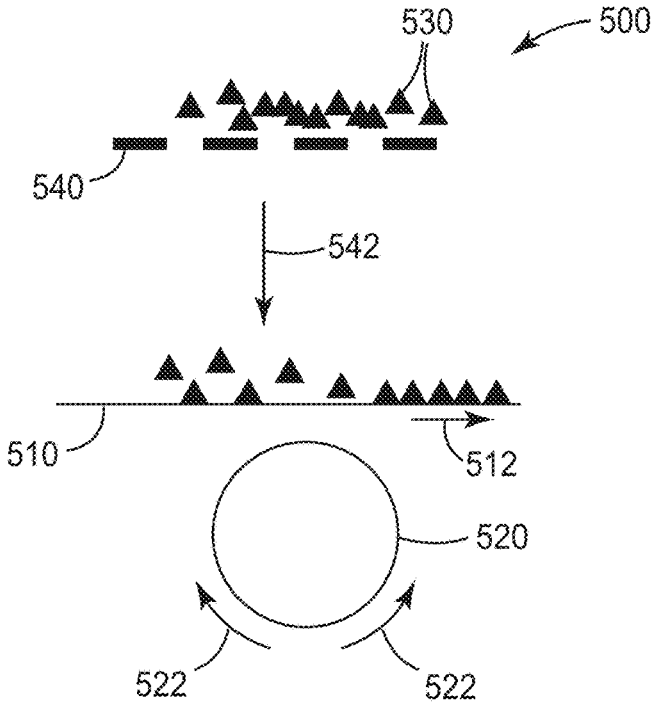
FIGS. 5A and 5B illustrates example electrostatic systems in accordance with embodiments of the present invention.
Figure 5B:
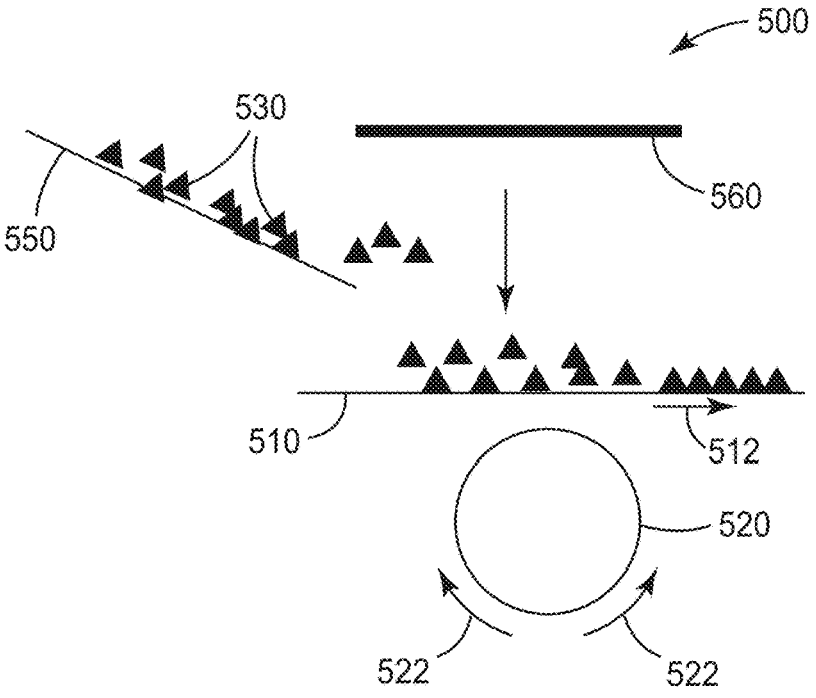

FIGS. 5A and 5B illustrate example processes for applying particles to a substrate in an embodiment of the invention. FIG. 5A illustrates an embodiment where particles 530 are provided for attachment through a screen 540, while FIG. 5B illustrates particles 530 being provided on a conveyance mechanism 550. However, it is expressly contemplated that other conveyance mechanism and arrangements are also possible. For example, use of a conveyance mechanism 550 may allow for a modulating field generator 520 to be located above incoming particles 530, instead of below, such that particles 530 are pulled against gravity to affix to a backing.

As illustrated in the embodiment of FIG. 5A, system 500 can receive a plurality of particles 530 for attachment to a substrate 510. Particles 530 can be provided on through a screen that can prevent particles above a maximum size from passing through. While FIG. 5A illustrates a conveyor and a screen positioned such that particles 530 fall through a field 542 onto a substrate, it is also expressly envisioned that, in other embodiments, particles 530 are provided such that they are transported against gravity to a substrate. For example, while an electrostatic field generator 520 is illustrated in FIG. 5 as being located below backing 510, it is also envisioned that field generator 520 can be located above substrate 510, with screen 530 located below substrate, such that particles are pulled, against gravity, toward substrate 510.

In one embodiment, substrate 510 moves in a direction as indicated by arrow 512, such that a particle deposition and alignment occur in a continuous process. However, batch deposition and alignment is also contemplated in other embodiments.

Electrostatic field generator 520 is configured to provide a modulated electrostatic field with an opposing stationary plate, which also serves as screen 540. While a single plate 540 is illustrated, it is also contemplated that an array of stationary electrodes 540 is also envisioned. Additionally, electrodes 540 may have a fixed charge or a charge sequence that is configured to change in unison with the rotation of field generator 520.

In one embodiment, modulation of the electrostatic field is accomplished by rotation of field generator 520, as indicated by arrows 520. However, electrostatic field generator 520 may also provide a modulated electrostatic field by moving back and fourth with respect to a stationary backing 510. Additionally, while only one electrostatic field generator 520 is illustrated in FIGS. 5A and 5B, it is expressly contemplated that a modulated electrostatic field can be produced using multiple sets of electrodes present above and/or below the backing web.

In FIG. 5B, conveyance mechanism 550 provides particles 530 using a ramp. However, in other embodiments, conveyance mechanism is a conveyor belt that travels horizontally without an angle. However, a ramp configuration may reduce the strength of field required to translate particles 530 against gravity, in embodiments where field generator 520 is located above substrate 510. Additionally, while only one field generator 520 is illustrated in FIGS. 5A and 5B, opposite a charged plate 540, it is expressly contemplated that a second modulating field generator may be present in other embodiments.

Abrasive Articles

The methods and systems described herein are useful for applying particles to a substrate in a preferred alignment. Such systems and methods are especially applicable in the abrasives industry. Abrasive particles, particularly shaped abrasive particles, can achieve higher working efficiency and/or longer useful life when aligned properly. Additionally, some shaped abrasive particles are designed to have a different abrading efficiency in a first direction than in a second direction. It is important, therefore, to be able to align a plurality of particles within an abrasive article such that they rotationally oriented within a preferred angle range with respect to the backing of the abrasive article. In some embodiments, it is preferred that the abrasive particles are aligned such that a width is parallel, or substantially parallel, to the edges of the backing.

Figure 6A:
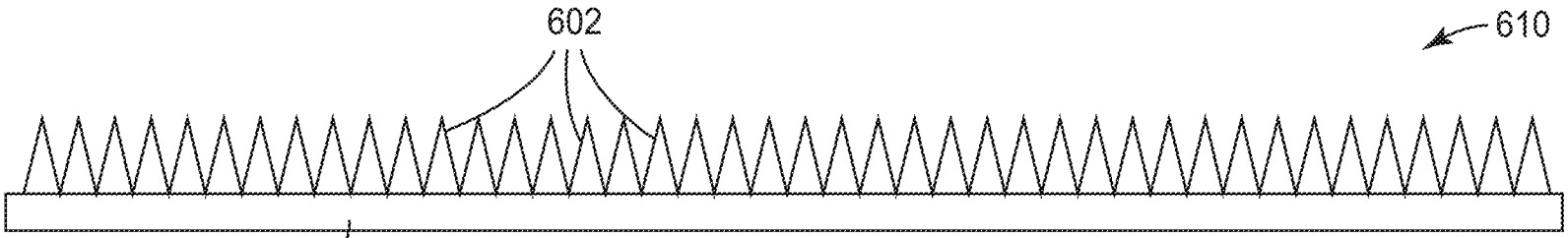
FIGS. 6A-6C illustrate aligned particles on a backing in an embodiment of the invention.
Figure 6B:
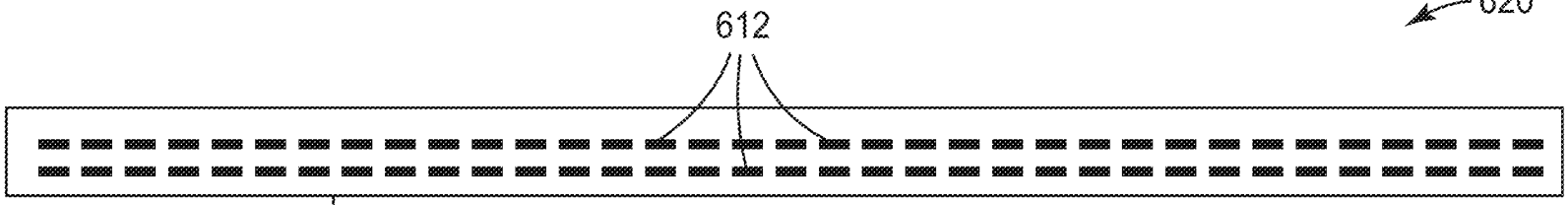
Figure 6C:
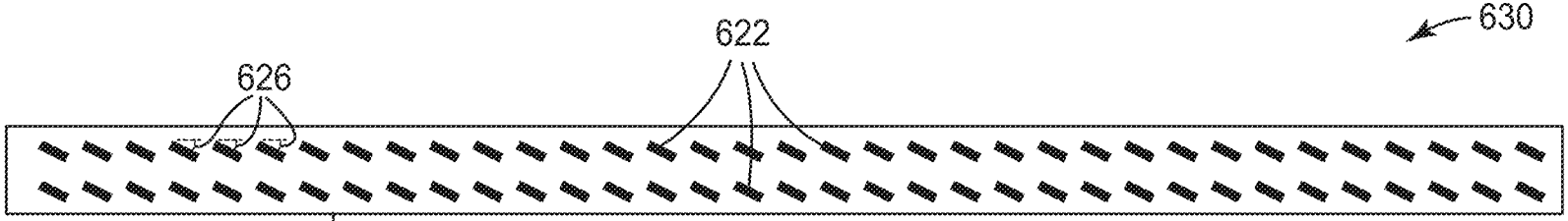

FIGS. 6A-6C illustrate abrasive articles in embodiments of the invention. FIGS. 6A-6C are illustrated for simplicity, for example without a make coat, size coat or other binder layer present to hold abrasive particles 602, 612 and 622 in place. The abrasive particles illustrated in FIG. 6A are triangular prisms. However, while triangular prisms are presented as an example, many other shapes are also possible. It is noted that, from a top view, as well as from up or down web, a properly placed triangular prism appears to be a rectangle.

FIG. 6A illustrates a side view of an abrasive article 610 with a plurality of abrasive particles 602 on a backing 604. In one embodiment, it is preferred that particles 602 align such that the bottom edge of each triangular prism particle 602 is in contact with backing 604 and is parallel to the edges of backing 604.

FIG. 6B illustrates a top-down view of an abrasive article 620 with a plurality of abrasive particles 612 on a backing 614. Only two rows of abrasive particles 612 is illustrated for ease of understanding. However, in some embodiments many more rows of abrasive particles 612 are present. Additionally, in some embodiments abrasive particles 612 will not align with respect to each other. Instead, each individual abrasive particle 612 will align within a modulated electrostatic field with respect to backing 614.

While FIGS. 6A and 6B illustrate embodiments where a preferred alignment is an abrasive particle substantially parallel to an edge of a substrate, as illustrated by abrasive article 630 in FIG. 6C, in other embodiments the preferred alignment is different. As illustrated in FIG. 6C, a preferred alignment can be a particle 622 at an angle 626 with respect to an edge of backing 624. Angle 626 can be set by the placement of substrate 624 with respect to the electrostatic field generated.

Further details concerning the manufacture of coated abrasive articles according to the present disclosure can be found in, for example, U.S. Pat. No. 4,314,827 (Leitheiser et al.), U.S. Pat. No. 4,652,275 (Bloecher et al.), U.S. Pat. No. 4,734,104 (Broberg), U.S. Pat. No. 4,751,137 (Tumey et al.), U.S. Pat. No. 5,137,542 (Buchanan et al.), U.S. Pat. No. 5,152,917 (Pieper et al.), U.S. Pat. No. 5,417,726 (Stout et al.), U.S. Pat. No. 5,573,619 (Benedict et al.), U.S. Pat. No. 5,942,015 (Culler et al.), and U.S. Pat. No. 6,261,682 (Law).

Nonwoven abrasive articles typically include a porous (e.g., a lofty open porous) polymer filament structure having abrasive particles bonded thereto by a binder. Further details concerning the manufacture of nonwoven abrasive articles according to the present disclosure can be found in, for example, U.S. Pat. No. 2,958,593 (Hoover et al.), U.S. Pat. No. 4,018,575 (Davis et al.), U.S. Pat. No. 4,227,350 (Fitzer), U.S. Pat. No. 4,331,453 (Dau et al.), U.S. Pat. No. 4,609,380 (Barnett et al.), U.S. Pat. No. 4,991,362 (Heyer et al.), U.S. Pat. No. 5,554,068 (Carr et al.), U.S. Pat. No. 5,712,210 (Windisch et al.), U.S. Pat. No. 5,591,239 (Edblom et al.), U.S. Pat. No. 5,681,361 (Sanders), U.S. Pat. No. 5,858,140 (Berger et al.), U.S. Pat. No. 5,928,070 (Lux), U.S. Pat. No. 6,017,831 (Beardsley et al.), U.S. Pat. No. 6,207,246 (Moren et al.), and U.S. Pat. No. 6,302,930 (Lux).

The abrasive particles described with respect to abrasive articles and methods of manufacture herein can be particles of any abrasive material. Useful abrasive materials that can be used include, for example, fused aluminum oxide, heat treated aluminum oxide, white fused aluminum oxide, ceramic aluminum oxide materials such as those commercially available as 3M CERAMIC ABRASIVE GRAIN from 3M Company of St. Paul, Minn., black silicon carbide, green silicon carbide, titanium diboride, boron carbide, tungsten carbide, titanium carbide, cubic boron nitride, garnet, fused alumina zirconia, sol-gel derived ceramics (e.g., alumina ceramics doped with chromia, ceria, zirconia, titania, silica, and/or tin oxide), silica (e.g., quartz, glass beads, glass bubbles and glass fibers), feldspar, or flint. Examples of sol-gel derived crushed ceramic particles can be found in U.S. Pat. No. 4,314,827 (Leitheiser et al.), U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). Further details concerning methods of making sol-gel-derived abrasive particles can be found in, for example, U.S. Pat. No. 4,314,827 (Leitheiser), U.S. Pat. No. 5,152,917 (Pieper et al.), U.S. Pat. No. 5,213,591 (Celikkaya et al.), U.S. Pat. No. 5,435,816 (Spurgeon et al.), U.S. Pat. No. 5,672,097 (Hoopman et al.), U.S. Pat. No. 5,946,991 (Hoopman et al.), U.S. Pat. No. 5,975,987 (Hoopman et al.), and U.S. Pat. No. 6,129,540 (Hoopman et al.), and in U.S. Publ. Pat. Appln. Nos. 2009/0165394 A1 (Culler et al.) and 2009/0169816 A1 (Erickson et al.).

The abrasive particles may be shaped (e.g., precisely-shaped) or random (e.g., crushed and/or platey). Shaped abrasive particles and precisely-shaped abrasive particles may be prepared by a molding process using sol-gel technology as described, for example, in U.S. Pat. No. 5,201,916 (Berg), U.S. Pat. No. 5,366,523 (Rowenhorst (Re 35,570)), U.S. Pat. No. 5,984,988 (Berg), U.S. Pat. No. 8,142,531 (Adefris et al.), and U. S. Pat. Appln. Publ. No. 2010/0146867 (Boden et al.).

U.S. Pat. No. 8,034,137 (Erickson et al.) describes alumina particles that have been formed in a specific shape, then crushed to form shards that retain a portion of their original shape features. In some embodiments, the abrasive particles are precisely-shaped (i.e., the abrasive particles have shapes that are at least partially determined by the shapes of cavities in a production tool used to make them).

Exemplary shapes of abrasive particles include crushed, pyramids (e.g., 3-, 4-, 5-, or 6-sided pyramids), truncated pyramids (e.g., 3-, 4-, 5-, or 6-sided truncated pyramids), cones, truncated cones, rods (e.g., cylindrical, vermiform), and prisms (e.g., 3-, 4-, 5-, or 6-sided prisms). In some embodiments (e.g., truncated pyramids and prisms), the abrasive particles respectively comprise platelets having two opposed major facets connected to each other by a plurality of side facets.

In some embodiments, the abrasive particles and/or magnetizable abrasive particles have an aspect ratio of at least 2, at least 3, at least 5, or even at least 10, although this is not a requirement.

Preferably, abrasive particles used in practice of the present disclosure have a Mohs hardness of at least 6, at least 7, or at least 8, although other hardnesses can also be used.

Further details concerning abrasive particles and methods for their preparation can be found, for example, in U.S. Pat. No. 8,142,531 (Adefris et al.), U.S. Pat. No. 8,142,891 (Culler et al.), and U.S. Pat. No. 8,142,532 (Erickson et al.), and in U. S. Pat. Appl. Publ. Nos. 2012/0227333 (Adefris et al.), 2013/0040537 (Schwabel et al.), and 2013/0125477 (Adefris). The abrasive particles are typically selected to correspond to abrasives' industry accepted nominal grades such as, for example, the American National Standards Institute, Inc. (ANSI) standards, Federation of European Producers of Abrasive Products (FEPA) standards, and Japanese Industrial Standard (JIS) standards. Exemplary ANSI grade designations (i.e., specified nominal grades) include: ANSI 4, ANSI 6, ANSI 8, ANSI 16, ANSI 24, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600. Exemplary FEPA grade designations include: P8, P12, P16, P24, P36, P40, P50, P60, P80, P100, P120, P180, P220, P320, P400, P500, 600, P800, P1000, and P1200. Exemplary JIS grade designations include: JIS8, JIS12, JIS16, JIS24, JIS36, JIS46, JIS54, JIS60, JIS80, JIS100, JIS150, JIS180, JIS220, JIS240, JIS280, JIS320, JIS360, JIS400, JIS400, JIS600, JIS800, JIS1000, JIS1500, JIS2500, JIS4000, JIS6000, JIS8000, and JIS10,000.

Alternatively, the abrasive particles can be graded to a nominal screened grade using U.S.A. Standard Test Sieves conforming to ASTM E-11 "Standard Specification for Wire Cloth and Sieves for Testing Purposes". ASTM E-11 prescribes the requirements for the design and construction of testing sieves using a medium of woven wire cloth mounted in a frame for the classification of materials according to a designated particle size. A typical designation may be represented as −18+20 meaning that the magnetizable abrasive particles pass through a test sieve meeting ASTM E-11 specifications for the number 18 sieve and are retained on a test sieve meeting ASTM E-11 specifications for the number 20 sieve. In one embodiment, the magnetizable abrasive particles have a particle size such that most of the particles pass through an 18-mesh test sieve and can be retained on a 20, 25, 30, 35, 40, 45, or 50 mesh test sieve. In various embodiments, the magnetizable abrasive particles can have a nominal screened grade of: −18+20, −20/+25, −25+30, −30+35, −35+40, −40+45, −45+50, −50+60, −60+70, −70/+80, −80+100, −100+120, −120+140, −140+170, −170+200, −200+230, −230+270, −270+325, −325+400, −400+450, −450+500, or −500+635. Alternatively, a custom mesh size can be used such as −90+100.

Electrostatic systems and methods described herein can also be used to apply filler particles to the coated backing. Useful filler particles include silica such as quartz, glass beads, glass bubbles and glass fibers; silicates such as talc, clays (e.g., montmorillonite), feldspar, mica, calcium silicate, calcium metasilicate, sodium aluminosilicate, sodium silicate; metal sulfates such as calcium sulfate, barium sulfate, sodium sulfate, aluminum sodium sulfate, aluminum sulfate; gypsum; vermiculite; wood flour; aluminum trihydrate;

carbon black; aluminum oxide; titanium dioxide; cryolite; chiolite; and metal sulfites such as calcium sulfite.

The new electrostatic system can be used to apply grinding aid particles to the coated backing. Exemplary grinding aids, which may be organic or inorganic, include waxes, halogenated organic compounds such as chlorinated waxes like tetrachloronaphthalene, pentachloronaphthalene, and polyvinyl chloride; halide salts such as sodium chloride, potassium cryolite, sodium cryolite, ammonium cryolite, potassium tetrafluoroborate, sodium tetrafluoroborate, silicon fluorides, potassium chloride, magnesium chloride; and metals and their alloys such as tin, lead, bismuth, cobalt, antimony, cadmium, iron, and titanium; and the like. Examples of other grinding aids include sulfur, organic sulfur compounds, graphite, and metallic sulfides. A combination of different grinding aids can be used. The grinding aid may be formed into particles or particles having a specific shape as disclosed in U.S. Pat. No. 6,475,253.

Abrasive articles according to the present disclosure are useful for abrading a workpiece. Methods of abrading range from snagging (i.e., high pressure high stock removal) to polishing (e.g., polishing medical implants with coated abrasive belts), wherein the latter is typically done with finer grades of abrasive particles. One such method includes the step of frictionally contacting an abrasive article (e.g., a coated abrasive article, a nonwoven abrasive article, or a bonded abrasive article) with a surface of the workpiece, and moving at least one of the abrasive article or the workpiece relative to the other to abrade at least a portion of the surface.

Examples of workpiece materials include metal, metal alloys, exotic metal alloys, ceramics, glass, wood, wood-like materials, composites, painted surfaces, plastics, reinforced plastics, stone, and/or combinations thereof. The workpiece may be flat or have a shape or contour associated with it. Exemplary workpieces include metal components, plastic components, particleboard, camshafts, crankshafts, furniture, and turbine blades.

Abrasive articles according to the present disclosure may be used by hand and/or used in combination with a machine. At least one of the abrasive article and the workpiece is moved relative to the other when abrading. Abrading may be conducted under wet or dry conditions. Exemplary liquids for wet abrading include water, water containing conventional rust inhibiting compounds, lubricant, oil, soap, and cutting fluid. The liquid may also contain defoamers, degreasers, for example.

ADDITIONAL EMBODIMENTS

The following exemplary embodiments are provided, the numbering of which is not to be construed as designating levels of importance:

Embodiment 1 is a method of orienting abrasive particles on a substrate. The method includes providing a substrate. The method also includes providing abrasive particles. The method also includes generating a modulated electrostatic field. The modulated electrostatic field is configured to have a first effective direction at a first time and a second effective direction at a second time. The electrostatic field is configured to cause the abrasive particles to align rotationally in both a z-direction and a y-direction.

Embodiment 2 includes the features of embodiment 1, however, the electrostatic field causes the abrasive particles to contact the substrate.

Embodiment 3 includes the features of any of embodiments 1 or 2, however a timestep between the first time and the second time is at least about 0.01 ms.

Embodiment 4 includes the features of any of embodiments 1-3, however a timestep between the first time and the second time is at least about 0.1 ms.

Embodiment 5 includes the features of any of embodiments 1-4, however a timestep between the first time and the second time is at least about 1 ms.

Embodiment 6 includes the features of any of embodiments 1-5, however a timestep between the first time and the second time is at least about 10 ms.

Embodiment 7 includes the features of any of embodiments 1-6, however a timestep between the first time and the second time is at least about 100 ms.

Embodiment 8 includes the features of any of embodiments 1-7, however the abrasive particles are crushed, platey, formed or shaped abrasive particles.

Embodiment 9 includes the features of any of embodiments 1-8, however the abrasive particles are shaped abrasive particles, and wherein the shape is selected from a pyramid, a truncated pyramid, a cone, a truncated cone, a rod, a trapezoidal prism, or a regular prism.

Embodiment 10 includes the features of any of embodiments 1-9, however the substrate is a nonwoven backing.

Embodiment 11 includes the features of any of embodiments 1-10, however the substrate is flexible.

Embodiment 12 includes the features of any of embodiments 1-11, however the substrate is a stiff Embodiment 13 includes the features of any of embodiments 1-12, however it also includes binding the abrasive particles to the substrate.

Embodiment 14 includes the features of embodiment 13, however binding comprises providing a binder precursor on the substrate and curing the binder precursor after the abrasive particles are rotationally aligned.

Embodiment 15 includes the features of embodiment 13, however binding comprises providing a binder after the abrasive particles are rotationally aligned on the substrate.

Embodiment 16 includes the features of any of embodiments 1-15, however a majority of the plurality of abrasive particles are oriented such that a face of each abrasive particle is rotationally aligned between about 45° and about 135° in the in a y-direction.

Embodiment 17 includes the features of any of embodiments 1-16, however the method is a batch process.

Embodiment 18 includes the features of any of embodiments 1-16, however the method is a continuous process.

Embodiment 19 includes the features of any of embodiments 1-18, however the generated electrostatic field is generated by a first electrode and a second electrode, wherein the substrate is provided between the first and second electrode, and wherein the abrasive particles are drawn toward the substrate.

Embodiment 20 includes the features of embodiment 19, however the abrasive particles are drawn toward the substrate against gravity.

Embodiment 21 includes the features of embodiment 19 or 20, however the first electrode provides a modulated electrostatic field by changing the effective direction of the electrostatic field over time.

Embodiment 22 includes the features of embodiment 21, however the first electrode rotates.

Embodiment 23 includes the features of embodiment 22, however the second electrode maintains a constant charge state during the process.

Embodiment 24 includes the features of embodiment 21, however the second electrode provides a modulated electrostatic field by changing the effective direction of the electrostatic field over time.

Embodiment 25 includes the features of any of embodiments 19-24, however the first electrode is a set of first electrodes. The second electrode is a set of second electrodes. The substrate is configured to pass between the first set of electrodes and the second set of electrodes.

Embodiment 26 includes the features of embodiment 25, however the set of electrodes comprises at least three electrodes.

Embodiment 27 includes the features of any of embodiments 25-26, however two adjacent first electrodes have different charge states. The modulated electrostatic field is provided as the substrate passes between the first and second sets of electrodes.

Embodiment 28 includes the features of any of embodiments 25-27, however one electrode in the first set of electrodes is configured to change its charge state during a dwell time of the alignment process.

Embodiment 29 includes the features of any of embodiments 25-28, however a charge state of each of the electrodes in the first and second sets of electrodes is positive, negative or ground.

Embodiment 30 includes the features of any of embodiments 1-29, however the provided abrasive particles are substantially unresponsive to a magnetic field.

Embodiment 31 includes the features of any of embodiments 1-30, however the provided abrasive particles are substantially free of iron, cobalt or nickel.

Embodiment 32 includes the features of any of embodiments 1-31, however the provided abrasive particles are ceramic abrasive particles.

Embodiments 33 includes the features of any of embodiments 1-32, however the provided abrasive particles comprise alpha alumina.

Embodiment 34 includes the features of any of embodiments 1-33, however more of the abrasive particles are aligned parallel to each other than would be expected by a random distribution of particles.

Embodiment 35 includes the features of any of embodiments 1-34, however it also includes applying a binder precursor and activating the applied binder precursor to bind the aligned particles to the substrate.

Embodiment 36 includes the features of any of embodiments 1-35, however the first effective direction acts on the particle in a first angular direction with respect to the substrate. The second effective direction acts on the particle in a second angular direction with respect to the substrate. The first and second angular directions are different.

Embodiment 37 includes the features of any of embodiments 1-36, however the first effective direction and the second effective direction define a plane to which the abrasive particles are aligned.

Embodiment 38 is an abrasive article. The abrasive article includes a substrate and a plurality of abrasive particles attached to the substrate. A majority of the plurality of particles are oriented with respect to the substrate. The orientation comprises orientation along a z-direction and a y-direction rotational orientation. The plurality of abrasive particles are substantially non-responsive to a magnetic field.

Embodiment 39 includes the features of embodiment 38, however the abrasive particles are shaped abrasive particles. The shape is selected from a pyramid, a truncated pyramid, a cone, a truncated cone, a rod, a trapezoidal prism, or a regular prism.

Embodiment 40 includes the features of embodiment 39, however the substrate comprises a nonwoven backing.

Embodiment 41 includes the features of any of embodiments 38-40, however the substrate is a flexible backing.

Embodiment 42 includes the features of any of embodiments 38-40, however the substrate is a stiff backing.

Embodiment 43 includes the features of any of embodiments 38-42, however the abrasive particles are bonded to the substrate.

Embodiment 44 includes the features of embodiment 43, however the abrasive particles are bonded within a make coat.

Embodiment 45 includes the features of embodiment 44, however it also includes a size coat.

Embodiment 46 includes the features of embodiment 43, however a binder is applied over the particles to maintain the contact between the particles and the substrate. Embodiment 47 includes the features of embodiment 46, however the binder is a resin binder.

Embodiment 48 includes the features of any of embodiments 38-47, however it also includes a fuller material.

Embodiment 49 includes the features of any of embodiments 38-48, however it also includes a grinding aid.

Embodiment 50 includes the features of any of embodiments 38-49, however it also includes a lubricant.

Embodiment 51 includes the features of any of embodiments 38-50, however each of the plurality of abrasive particles contain less than 0.5% by weight of any of iron, cobalt or nickel.

Embodiment 52 includes the features of any of embodiments 38-51, however each of the plurality of abrasive particles contain less than 0.2% by weight of any of iron, cobalt or nickel.

Embodiment 53 includes the features of any of embodiments 38-52, however each of the plurality of abrasive particles contain less than 0.1% by weight of any of iron, cobalt or nickel.

Embodiment 54 includes the features of any of embodiments 38-53, however a majority of the plurality of abrasive particles are oriented such that a length of the abrasive particle is substantially perpendicular to the substrate.

Embodiment 55 includes the features of any of embodiments 38-54, however a majority of the plurality of abrasive particles are oriented such that a length of the abrasive particle is angled with respect to the substrate.

Embodiment 56 includes the features of any of embodiments 38-55, however a majority of the plurality of abrasive particles are oriented such that they are rotationally aligned in the y-direction between about 45° and about 135° with respect to the substrate. Embodiment 57 is a method of aligning particles on a substrate. The method includes providing a substrate. The method also includes providing a plurality of particles. The method also includes generating an electrostatic field. The method also includes modulating the generated electrostatic field such that a majority of the plurality of particles undergo an alignment change in both a z-direction and a y-direction with respect to the substrate. The method also includes affixing the particles to the substrate.

Embodiment 58 includes the features of embodiment 57, however the method is a batch process.

Embodiment 59 includes the features of embodiment 57, however the method is a continuous process.

Embodiment 60 includes the features of any of embodiments 57-59, however the generated electrostatic field is generated by a first electrode and a second electrode. The substrate is provided between the first and second electrode. The particles are drawn toward the substrate.

Embodiment 61 includes the features of any of embodiments 57-60, however the electrostatic field is strong enough such that particles are drawn toward the substrate against gravity.

Embodiment 62 includes the features of any of embodiments 60-61, however the first electrode provides a modulated electrostatic field by changing the experienced electrostatic field over time.

Embodiment 63 includes the features of embodiment 62, however the first electrode rotates.

Embodiment 64 includes the features of any of embodiments 60-63, however the second electrode maintains a constant charge state during the process.

Embodiment 65 includes the features of any of embodiments 60-64, however the second electrode provides a modulated electrostatic field by changing the experienced electrostatic field from a first effective direction at a first time to a second effective direction at a second time.

Embodiment 66 includes the features of any of embodiments 60-65, however the first electrode is a set of first electrodes. The second electrode is a set of second electrodes. The substrate is configured to pass between the first set of electrodes and the second set of electrodes.

Embodiment 67 includes the features of embodiment 66, however the set of electrodes comprises at least three electrodes.

Embodiment 68 includes the features of any of embodiments 66-67, however two adjacent first electrodes have different charge states. The modulated electrostatic field is provided as the substrate passes between the first and second sets of electrodes.

Embodiment 69 includes the features of any of embodiments 66-68, however one electrode in the first set of electrodes is configured to change its charge state during a dwell time of the alignment process.

Embodiment 70 includes the features of any of embodiments 66-69, however a charge state of each of the electrodes in the first and second sets of electrodes is positive, negative or ground.

Embodiment 71 includes the features of any of embodiments 57-70, however the non-magnetic particles are substantially unresponsive to a magnetic field.

Embodiment 72 includes the features of any of embodiments 57-71, however the non-magnetic particles are substantially free of iron.

Embodiment 73 includes the features of any of embodiments 57-72, however the particles are abrasive particles.

Embodiment 74 includes the features of embodiment 73, however the abrasive particles are fused aluminum oxide, heat treated aluminum oxide, white fused aluminum oxide, ceramic aluminum oxide, black silicon carbide, green silicon carbide, titanium diboride, boron carbide, tungsten carbide, titanium carbide, cubic boron nitride, garnet, fused alumina zirconia, sol-gel derived ceramics, silica, feldspar, or flint.

Embodiment 75 includes the features of embodiments 57-74, however the substrate is a backing for an abrasive article.

EXAMPLES

Objects and advantages of this invention are further illustrated by the following non-limiting examples; however, the particular materials and amounts thereof recited in these examples, as well as other conditions and details, should not be construed to unduly limit this invention. Unless otherwise noted, all parts, percentages, ratios, etc. in the Examples and the rest of the specification are by weight.

Example 1

Figure 7A:
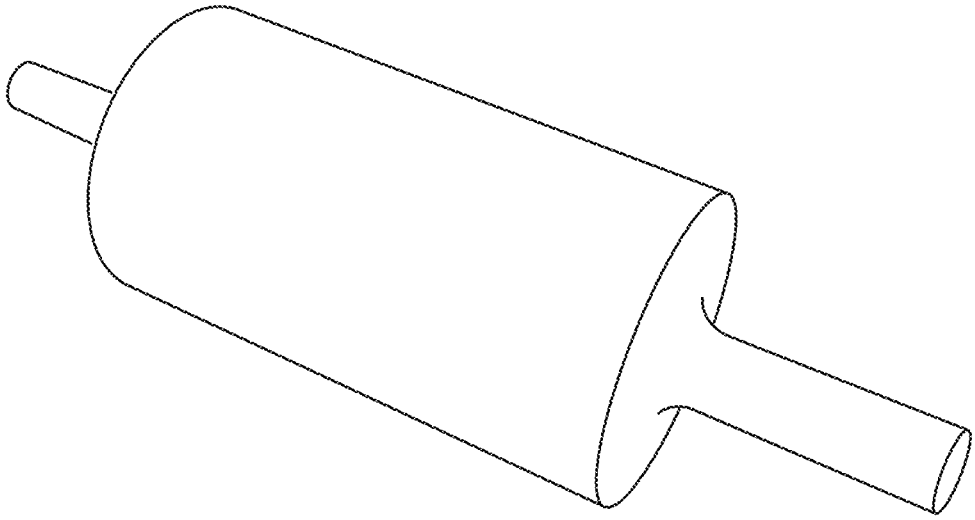
FIGS. 7A-7B illustrate a system for aligning particles on a backing in an embodiment of the invention.
Figure 7B:
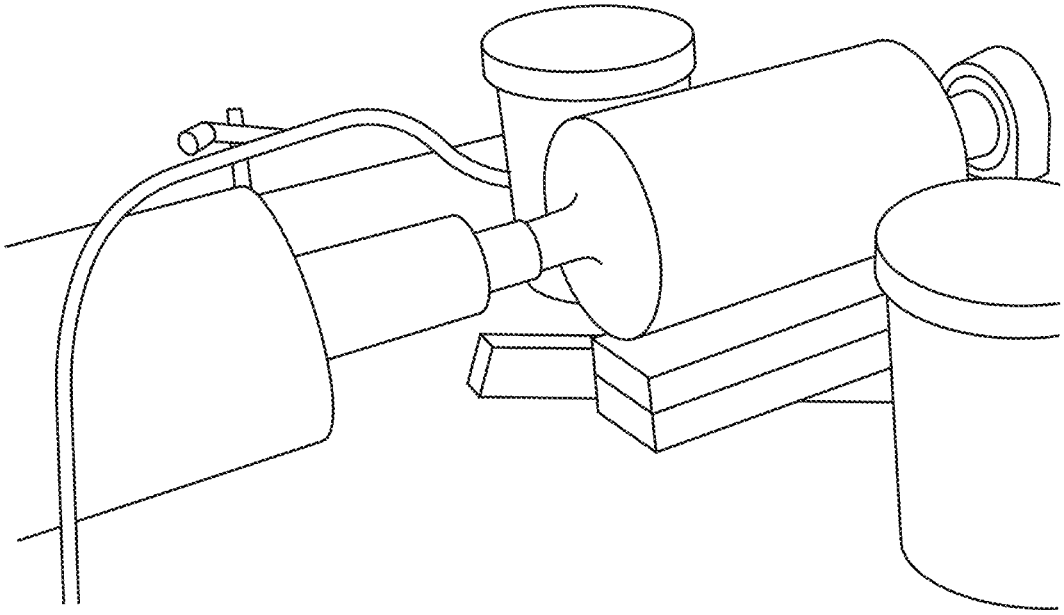

A rotating cylinder was used to modulate electrostatic fields. The cylinder dimensions were 4 inches in diameter by 6 inch wide and was rotated at 2000 rpm. The ends of the cylinder tapered down to a one-inch shaft to allow for mounting to a DC motor with a coupling on one end and a pillow block bearing on the other. The cylinder was hollow and had 0.25 inch thick walls throughout. The cylinder was created via a viper SLA 3D printer with a clear polymer resin. Copper conductive paths were taped on the cylinder to create cross-web ribs as illustrated in FIGS. 7A-7B. The traces were 1 inch wide and had 1 inch spacing between each. At the edge of the cylinder, a piece of copper tape was wrapped all the way around such that all copper traces were in contact with each other. An additional copper trace was put on the shaft such that a charged wired could drag against it and keep constant contact while the cylinder was spinning. The copper traces were all charged to 10 kv with 0 milliamps.

Equilateral triangle shaped ceramic particles and precisely-shaped ceramic particles were prepared by a molding process using sol-gel technology as described, for example, in U.S. Pat. No. 5,201,916 (Berg), U.S. Pat. No. 5,366,523 (Rowenhorst (Re 35,570)), U.S. Pat. No. 5,984,988 (Berg), U.S. Pat. No. 8,142,531 (Adefris et al.), and U.S. Pat. No. 8,764,865 (Boden et al.). The equilateral triangular shaped ceramic abrasive particles had an edge length of 205 microns and a thickness of 48 microns were placed on a grounded plate a 0.25 inches below the center of the cylinder. A length of two-inch wide 3M vinyl tape was placed in between the cylinder and the ground plate with the adhesive coated side down to serve as the coated web (setup is shown in FIGS. 7A and 7B).

An electric motor was used to get the cylinder to a speed of 2000 rpm and then the 10 kV charge was turned on. Voltage was supplied by an electrostatic power supply. The PSG particles jumped upward toward the charged cylinder and adhered to the tacky portion of the vinyl tape. 65% of particles were in an optimal orientation and 35% were in a sub-optimal orientation.

Example 2

The same method was used except that the cylinder had 2" wide rib of copper and there was no speed to the cylinder applied. 44% of particles were in an optimal orientation, and 56% of particles were in a sub-optimal position.

Example 3

8A illustrates a web that can move down-web in the direction of the arrow. A portion of the web length has electrodes A-I above the web, and electrodes J-R below the web. In this example the web is about midway between the upper and lower electrodes. These electrodes were modeled and simulated as an array of 18 copper wires, 0.02" diameter, vertically spaced 0.5", and spaced 0.25" horizontally. The wires are shown with an exaggerated diameter for clarity in this figure. The green cube indicates the point in space where the simulation analysis begins at time T1. The web may or may-not be moving in the direction of the purple arrow; the simulation and analysis is the same either way. However, it may be of use to move the web at the same speed as the rotating field travels, enabling a particle to remain in a rotating field that does not appear to be traveling, when viewed from the perspective of a particle on the moving web. To create a rotating electric field, the electrodes of FIG. 8A can be charged by a controller.

Figure 8A:
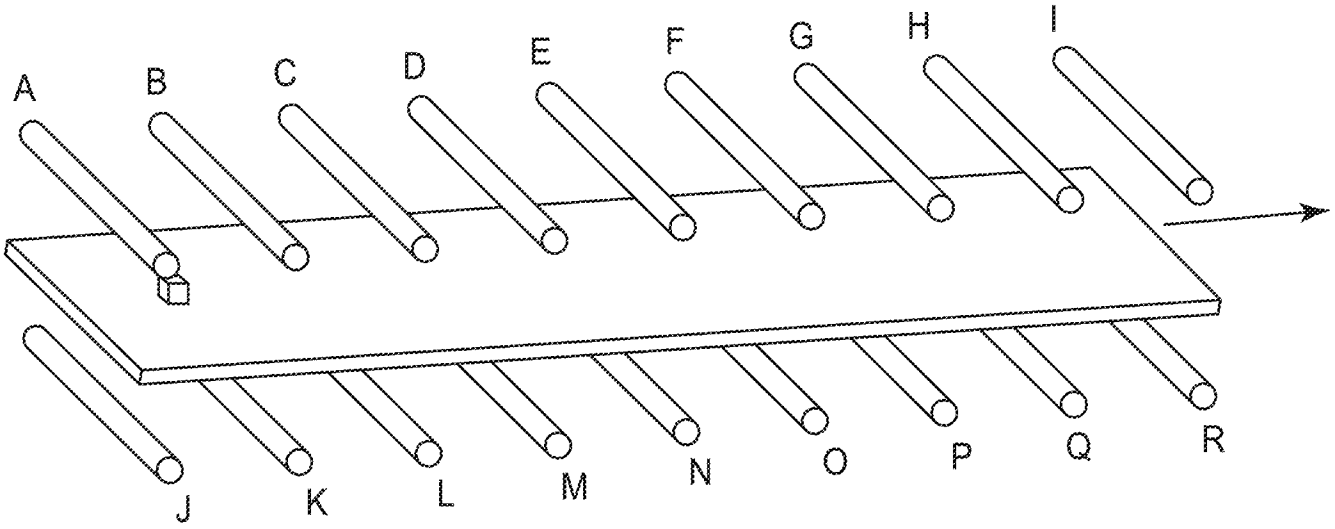

FIG. 8B shows a time sequence of voltages to be applied to the electrodes of FIG. 8A using a controller to create a rotating electric field starting at the position of the green cube of FIG. 8A. There is a cycle of 8 time steps shown in FIG. 8B. This cycle is repeated 2⅛ times in FIG. 8B and in 8D. Time step T9 begins the second loop thru the 8 time step cycle. This 8 step cycle can be repeated forever. Or this sequence can be reversed to generate an electric filed that rotates in the opposite direction and travels in the opposite direction. Other time step sequences can be used to generate other dynamic electric fields. In this table, a "+" symbol indicates that the Voltage Controller will deliver a large positive voltage (e.g., +5 kV) to the appropriate electrode for any given time step, and a "−" symbol indicates that the Voltage Controller will deliver a large negative voltage (e.g., −5 kV) to the appropriate electrode for that time step. The locations in this table that have no symbol indicate that the associated electrodes will be left floating for the associated time step.

Figure 8C:
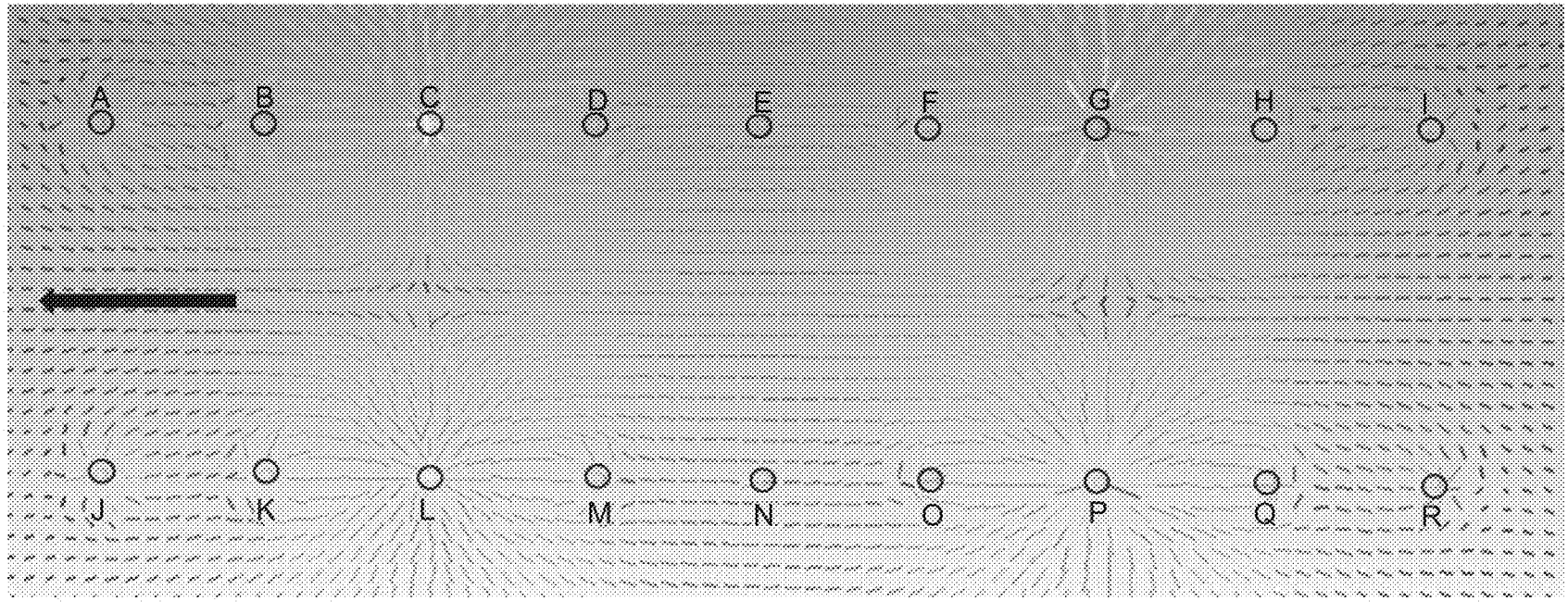

FIG. 8C shows the electric field simulation for the first time step T1. In this time step, electrodes C and L are charged to −5 kV, electrodes G and P are charged to +5 kV, and all other electrodes are not driven to a specific voltage but are left floating. The arrow indicates the direction of the electric field in the location of the box of FIG. 8A.

Figure 8D:
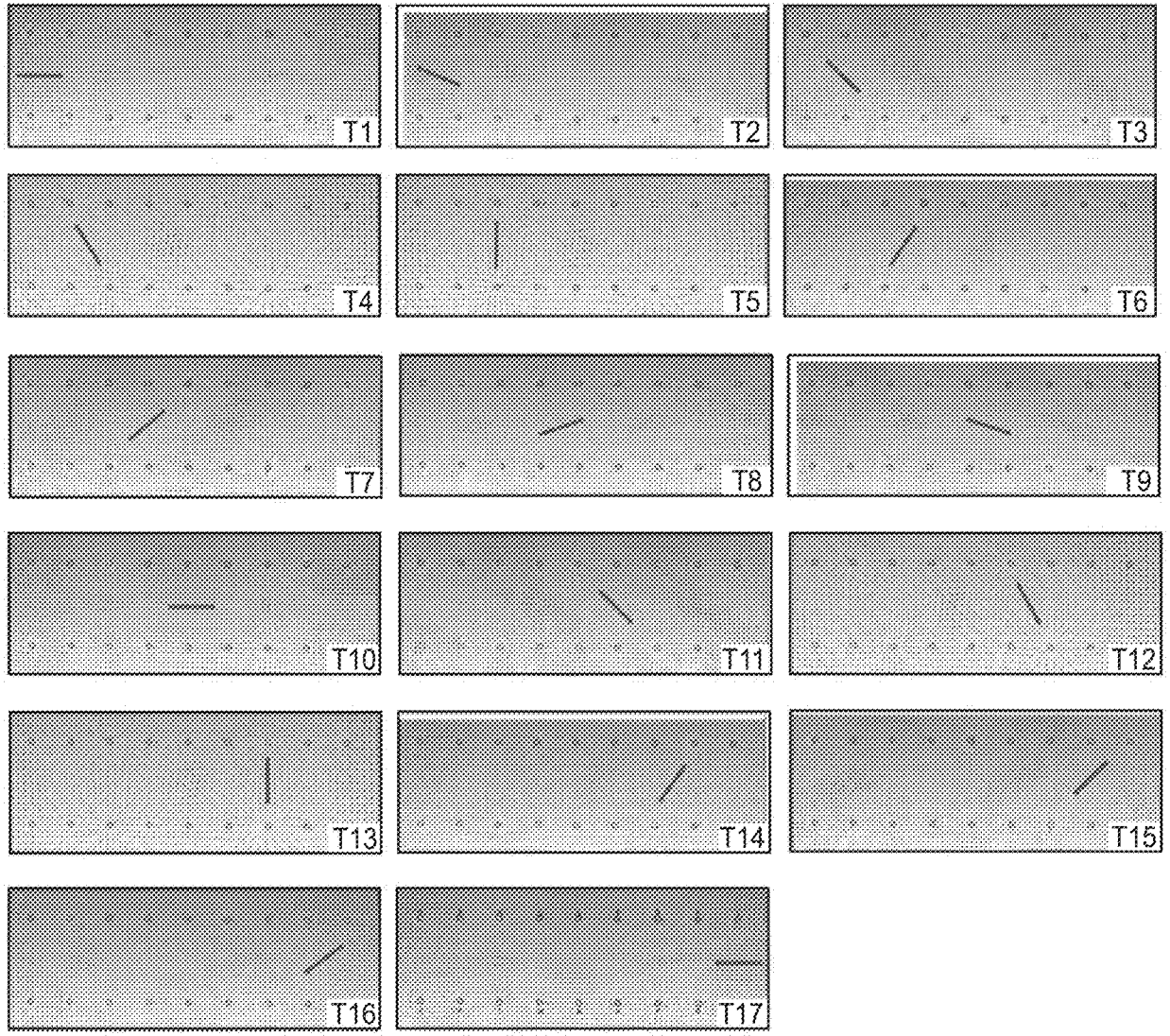

FIG. 8D illustrates a simulated electric field direction for each of time step sequence T1 thru T17.

What is claimed is:

1. A method of orienting abrasive particles on a substrate, the method comprising:

providing a substrate;

providing abrasive particles;

generating a modulated electrostatic field, wherein the modulated electrostatic field is configured to have a first effective direction at a first time and a second effective direction at a second time;

wherein the electrostatic field is configured to cause the abrasive particles to align rotationally in both a z-direction and a y-direction;

wherein the generated electrostatic field is generated by a first electrode and a second electrode, wherein the substrate is provided between the first and second electrode, and wherein the abrasive particles are drawn toward the substrate; and wherein the first electrode is a set of first electrodes and wherein the second electrode is a set of second electrodes, and wherein the substrate is configured to pass between the first set of electrodes and the second set of electrodes, and wherein the first electrode rotates.

2. The method of claim 1, wherein the electrostatic field causes the abrasive particles to contact the substrate.

3. The method of claim 1, wherein a timestep between the first time and the second time is at least about 0.01 ms.

4. The method of claim 1, wherein the first electrode provides a modulated electrostatic field by changing the effective direction of the electrostatic field over time.

5. The method of claim 4, wherein the second electrode provides a modulated electrostatic field by changing the effective direction of the electrostatic field over time.

6. The method of claim 1, wherein the set of electrodes comprises at least three electrodes.

7. The method of claim 1, wherein two adjacent first electrodes have different charge states, and wherein the modulated electrostatic field is provided as the substrate passes between the first and second sets of electrodes.

8. The method of claim 1, wherein one electrode in the first set of electrodes is configured to change its charge state during a dwell time of the alignment process.

9. A method of aligning particles on a substrate, the method comprising:

providing a substrate;

providing a plurality of particles;

generating an electrostatic field;

modulating the generated electrostatic field such that a majority of the plurality of particles undergo an alignment change in both a z-direction and a y-direction with respect to the substrate;

affixing the particles to the substrate;

wherein the generated electrostatic field is generated by a first electrode and a second electrode, wherein the substrate is provided between the first and second electrode, and wherein the particles are drawn toward the substrate; and wherein the second electrode rotates with respect to the first electrode, changing the experienced electrostatic field from a first effective direction at a first time to a second effective direction at a second time, providing a modulated electrostatic field by.

10. The method of claim 9, wherein the first electrode comprises a set of first electrodes and wherein the second electrode comprises a set of second electrodes, and wherein the substrate is configured to pass between the first set of electrodes and the second set of electrodes.

11. The method of claim 10, wherein two adjacent first electrodes have different charge states, and wherein the modulated electrostatic field is provided as the substrate passes between the first and second sets of electrodes.

12. The method of claim 10, wherein one electrode in the first set of electrodes is configured to change its charge state during a dwell time of the alignment process.

13. A method of orienting abrasive particles on a substrate, the method comprising:

providing a substrate;

providing abrasive particles;

generating a modulated electrostatic field, wherein the modulated electrostatic field is configured to have a first effective direction at a first time and a second effective direction at a second time;

wherein the electrostatic field is configured to cause the abrasive particles to align rotationally in both a z-direction and a y-direction;

wherein the generated electrostatic field is generated by a first electrode and a second electrode, wherein the substrate is provided between the first and second electrode, and wherein the abrasive particles are drawn toward the substrate;

wherein the first electrode rotates with respect to the second electrode, such that a modulated electrostatic field is provided by changing the effective direction of the electrostatic field over time.

* * * * *